US011919707B2

(12) United States Patent
Nyeboer et al.

(10) Patent No.: US 11,919,707 B2
(45) Date of Patent: Mar. 5, 2024

(54) SLIDING COVER ASSEMBLY FOR A DUNNAGE CONTAINER

(71) Applicant: BRADFORD COMPANY, Holland, MI (US)

(72) Inventors: Calvin D. Nyeboer, Holland, MI (US); Ronald Wilmot, Portland, TN (US); Russell S. Bowman, Hendersonville, TN (US)

(73) Assignee: BRADFORD COMPANY, Holland, MI (US)

( * ) Notice: Subject to any disclaimer, the term of this patent is extended or adjusted under 35 U.S.C. 154(b) by 136 days.

(21) Appl. No.: 17/617,331

(22) PCT Filed: Jun. 26, 2020

(86) PCT No.: PCT/US2020/039831

§ 371 (c)(1),
(2) Date: Dec. 8, 2021

(87) PCT Pub. No.: WO2020/264304

PCT Pub. Date: Dec. 30, 2020

(65) Prior Publication Data

US 2022/0219887 A1 Jul. 14, 2022

Related U.S. Application Data

(60) Provisional application No. 62/901,257, filed on Sep. 16, 2019, provisional application No. 62/867,326, filed on Jun. 27, 2019.

(51) Int. Cl.
*B65D 90/00* (2006.01)

(52) U.S. Cl.
CPC ..... *B65D 90/008* (2013.01)

(58) Field of Classification Search
CPC ..... B65D 2585/6887; B65D 90/021; B65D 83/267; B65D 90/008; B65D 90/0066;
(Continued)

(56) References Cited

U.S. PATENT DOCUMENTS 3,710,513 A * 1/1973 Richter ..... B65D 90/008 49/464
3,762,593 A * 10/1973 Beretta ..... B65D 19/12 220/489

(Continued)

FOREIGN PATENT DOCUMENTS

CN 107161552 A 9/2017
DE 4432195 C2 4/1999

OTHER PUBLICATIONS

PCT International Search Report and Written Opinion completed by the ISA/US dated Sep. 10, 2020 and issued in connection with PCT/US2020/039831.

*Primary Examiner* — Kareen K Thomas
(74) *Attorney, Agent, or Firm* — Barnes & Thornburg LLP

(57) ABSTRACT

A cover assembly for a dunnage container may include elongated first and second rails affixed to or integral with the container and extending along opposite edges of an opening thereto, first and second cover panels each configured to extend between the first and second rails over at least a portion of the opening and to slide along a parallel paths defined longitudinally along the first and second rails such that the cover panels can slidingly overlay one another, and a flexible panel affixed to and between opposing sides of the cover panels. The flexible panel is redirectable in response to sliding of either or both of the cover panels toward the other to trap the flexible panel therebetween as one overlays the other, and also in response to sliding of either or both of
(Continued)

the cover panels away from the other to extend the flexible panel therebetween.

19 Claims, 20 Drawing Sheets

(58) Field of Classification Search
CPC ..... B65D 2519/00174; B65D 2519/00273; B65D 2519/00323; B65D 2519/00502; B65D 2519/00532; B65D 2519/00626; B65D 2519/00701; B65D 2519/00805; B65D 25/005; B65D 19/06
See application file for complete search history.

(56) References Cited

U.S. PATENT DOCUMENTS 3,770,186 A * 11/1973 Kupersmit ..... B65D 19/20 108/56.1
3,813,117 A * 5/1974 Hackney, Jr. ..... B65D 90/008 292/259 R
3,860,138 A * 1/1975 Lovich ..... B65D 88/14 220/255
3,904,064 A * 9/1975 Looker ..... B65D 88/14 49/155
4,015,714 A * 4/1977 Silver ..... B65D 19/08 220/345.2
4,221,302 A * 9/1980 Kupersmit ..... B65D 19/20 220/4.31
4,426,020 A * 1/1984 Presseau ..... B65F 3/26 210/291
4,674,647 A * 6/1987 Gyenge ..... B65D 19/18 220/6
5,131,450 A * 7/1992 Lichy ..... E04H 4/101 160/310
5,312,182 A * 5/1994 Mlakar ..... B65D 88/005 312/293.3
5,413,410 A * 5/1995 Mlakar ..... B65D 88/14 312/293.3
5,570,801 A * 11/1996 Younger ..... B65D 90/021 220/315
5,599,082 A * 2/1997 Mlakar ..... B65D 88/14 312/293.3
5,667,002 A * 9/1997 Neustadt ..... B65D 90/021 160/368.1
5,875,904 A 3/1999 Vorstenbosch
6,581,999 B1 * 6/2003 Chapman ..... B65D 88/005 298/23 A
2002/0046678 A1 * 4/2002 Fecko ..... B65D 90/022 105/404
2002/0070215 A1 * 6/2002 Walsh ..... B65D 19/18 220/6
2008/0251514 A1 * 10/2008 Fitzpatrick ..... B65D 88/74 220/86.1
2010/0170908 A1 7/2010 Wolf
2017/0313500 A1 11/2017 Bradford et al.

* cited by examiner

SLIDING COVER ASSEMBLY FOR A DUNNAGE CONTAINER

CROSS-REFERENCE TO RELATED APPLICATIONS

This application is a U.S. national stage entry of International Application Serial No. PCT/US2020/039831, filed Jun. 26, 2020, which claims the benefit of, and priority to, U.S. Provisional Patent Application Ser. No. 62/867,326, filed Jun. 27, 2019, and U.S. Provisional Patent Application Ser. No. 62/901,257, filed Sep. 16, 2019, the disclosures of which are expressly incorporated herein by reference in their entireties.

TECHNICAL FIELD

The present disclosure relates generally to dunnage containers, and more specifically to sliding covers for side-loading and/or top-loading dunnage containers.

BACKGROUND

Some conventional dunnage containers have an open top via which objects are loaded into and unloaded from the container, i.e., a top-loading dunnage container, and other conventional dunnage containers similarly have at least one open side for loading and unloading objects, i.e., a side-loading dunnage container. Some such dunnage containers may include a flexible cover mounted thereto in the form of a curtain or flap having one end attached to the container along one side of the opening and three otherwise free ends. Some such curtains or flaps may be configured to be selectively attached along at least one free end thereof to at least one other side of the container to cover the open top or side.

SUMMARY

The present disclosure may comprise one or more of the features recited in the attached claims, and/or one or more of the following features and combinations thereof. In one aspect, a cover assembly for a dunnage container may comprise an elongated first rail affixed to or integral with the dunnage container and extending along one edge of an opening to the dunnage container, an elongated second rail affixed to or integral with the dunnage container and extending along another edge of the opening opposite the one edge, a first cover panel configured to extend between the first and second rails over at least a portion of the opening and to slide along a first path defined longitudinally along the first and second rails, a second cover panel configured to extend between the first and second rails over at least a portion of the opening and to slide along a second path defined longitudinally along the first and second rails parallel with the first path such that the first and second cover panels can slidingly overlay one another, and a flexible panel affixed to and between opposing sides of the first and second cover panels. The flexible panel is illustratively redirectable in response to sliding of either or both of the first and second cover panels toward the other to trap the flexible panel therebetween as one of the first and second cover panels overlays the other. The flexible panel is further illustratively redirectable in response to sliding of either or both of the first and second cover panels away from the other to extend the flexible panel therebetween.

In another aspect, a method provides for a selectively openable covering for an opening of a dunnage container, wherein the dunnage container has an elongated first rail affixed thereto or integral therewith and extending along one edge of the opening and an elongated second rail affixed thereto or integral therewith and extending along another edge of the opening opposite the one edge. The method may comprise positioning a first cover panel between the first and second rails over at least a portion of the opening so as to slide along a first path defined longitudinally along the first and second rails, positioning a second cover panel between the first and second rails over at least a portion of the opening so as to slide along a second path defined longitudinally along the first and second rails parallel with the first path and such that the first and second cover panels can slidingly overlay one another, and affixing a flexible panel to and between opposing sides of the first and second cover panels, wherein the flexible panel is redirectable in response to sliding of either or both of the first and second cover panels toward the other to trap the flexible panel therebetween as one of the first and second cover panels overlays the other, and wherein the flexible panel is further redirectable in response to sliding of either or both of the first and second cover panels away from the other to extend the flexible panel therebetween.

DESCRIPTION OF THE ILLUSTRATIVE EMBODIMENTS

Figure 1:
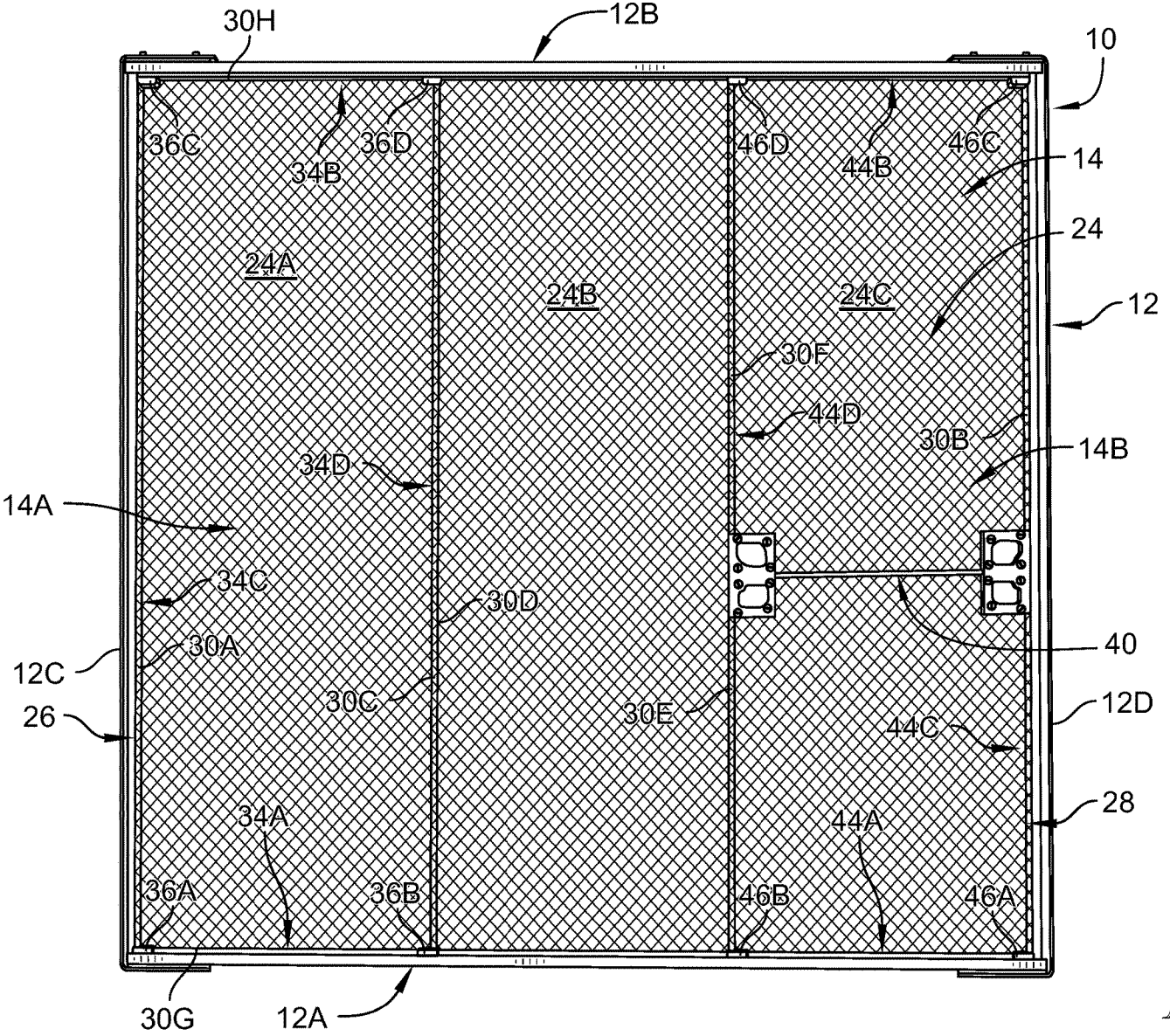
FIG. 1 is a front elevational view of an embodiment of a sliding cover assembly operatively mounted to a closed frame assembly representing an open top or side of a conventional top-loading or side-loading dunnage container.

For the purposes of promoting an understanding of the principles of this disclosure, reference will now be made to a number of illustrative embodiments shown in the attached drawings and specific language will be used to describe the same.

This disclosure relates to apparatuses and techniques for selectively covering and exposing a dunnage container access opening. In particular, a sliding cover assembly for a dunnage container access opening illustratively includes a flexible panel disposed and coupled between two sliding panels each slidable relative to the dunnage container frame. The flexible panel is redirectable in response to sliding of either or both of the sliding panels toward one another to trap the flexible panel between the two sliding panels as one slides over, or under, the other to expose the dunnage container access opening. The flexible panel is also redirectable in response to sliding of either or both of the sliding panels away from one another to extend the flexible panel between the sliding panels to cover the dunnage container access opening.

Referring to FIGS. 1-6 in particular, an embodiment is shown of a dunnage container closure arrangement 10 including a sliding cover assembly 14 operatively mounted to a closed, dunnage container frame assembly 12. In the context of this disclosure, the phrase "closed dunnage container frame assembly" refers to a dunnage container frame assembly having a unitary frame or connected frame components which, in either case, defines an outer, closed periphery of, or attached to, a dunnage container and which defines a dunnage container access opening therethrough. The access opening may illustratively be defined through the top of the container so as to define a top-loading dunnage container, or may be defined through one or more of the sides of the container so as to define a side-loading dunnage container.

In the illustrated embodiment, the dunnage container frame assembly 12 includes elongated, opposing rails 12A, 12B respectively, each secured at opposite ends thereof to spaced apart, elongated and opposed frame members 12C, 12D. In one embodiment, the frame assembly 12 is integral with the dunnage container such that the frame assembly 12 and the dunnage container are of unitary construction. In such embodiments, the frame assembly 12 thus represents an open framework of an open top or open side dunnage container. In some alternate embodiments, the frame members 12C, 12D represent sides of an open top or open side dunnage container, and in such embodiments the rails 12A, 12B are operatively mounted, in a conventional manner, to respective opposed frame members of the dunnage container to define the open framework of the open top or open side dunnage container. In still other alternate embodiments, the frame assembly 12 is separate from the dunnage container, and in such embodiments the rails 12A, 12B and the frame members 12C, 12D are all operatively mounted, in a conventional manner, to respective frame members of the dunnage container to define the open framework of the open top or open side dunnage container.

In any case, the frame assembly 12 defines an opening 50 therethrough (see, e.g., FIG. 2) which serves as the access opening to the dunnage container. In the illustrated embodiment, the frame assembly 12 is rectangular in shape and defines a rectangularly-shaped opening 50 therethrough. In alternate embodiments, the frame assembly 12 may define any closed shape and/or may define the opening 50 therethrough having any closed shape.

Figure 2:
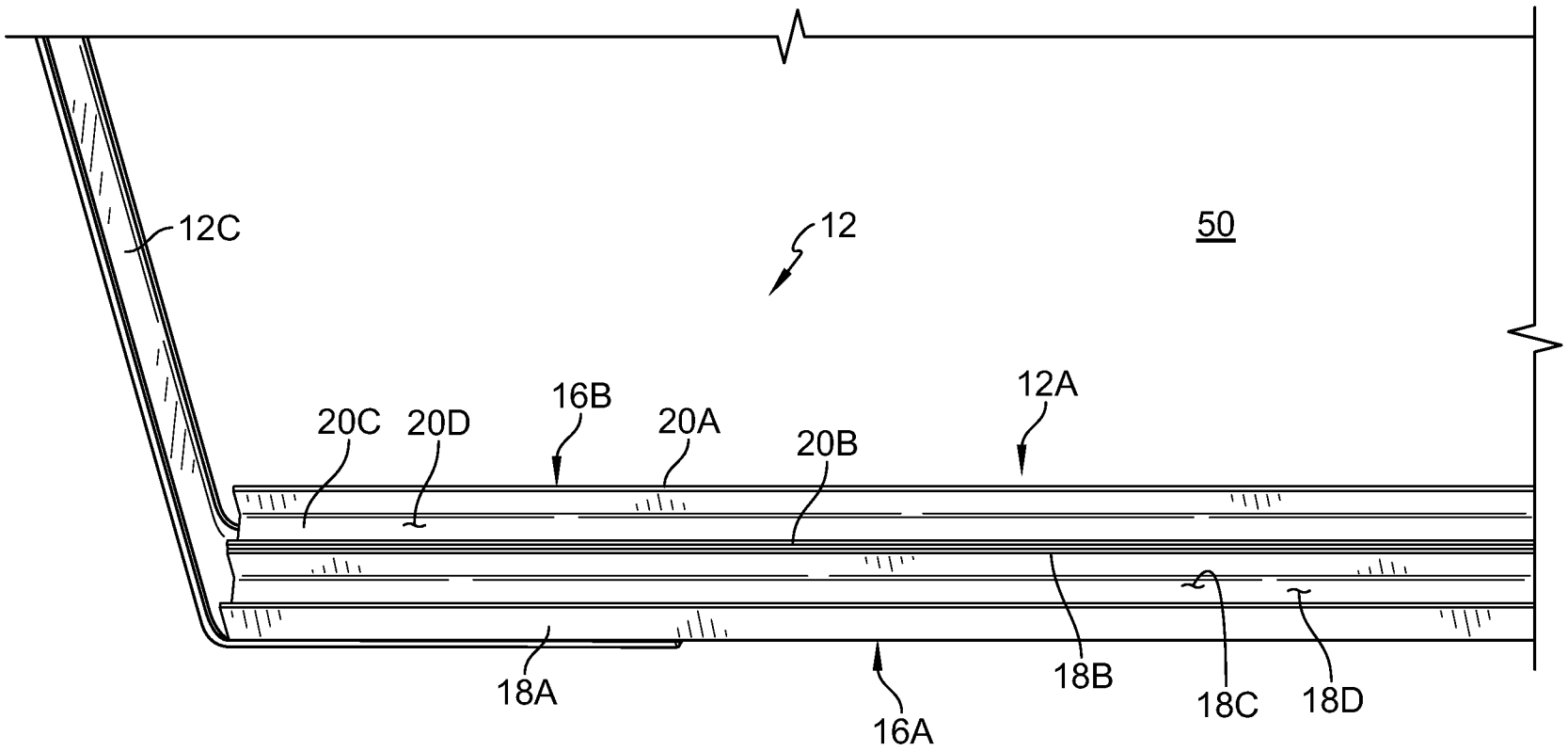
FIG. 2 is a magnified perspective view of a portion of one rail adjacent to one side of the frame assembly of the dunnage container.
Figure 3:
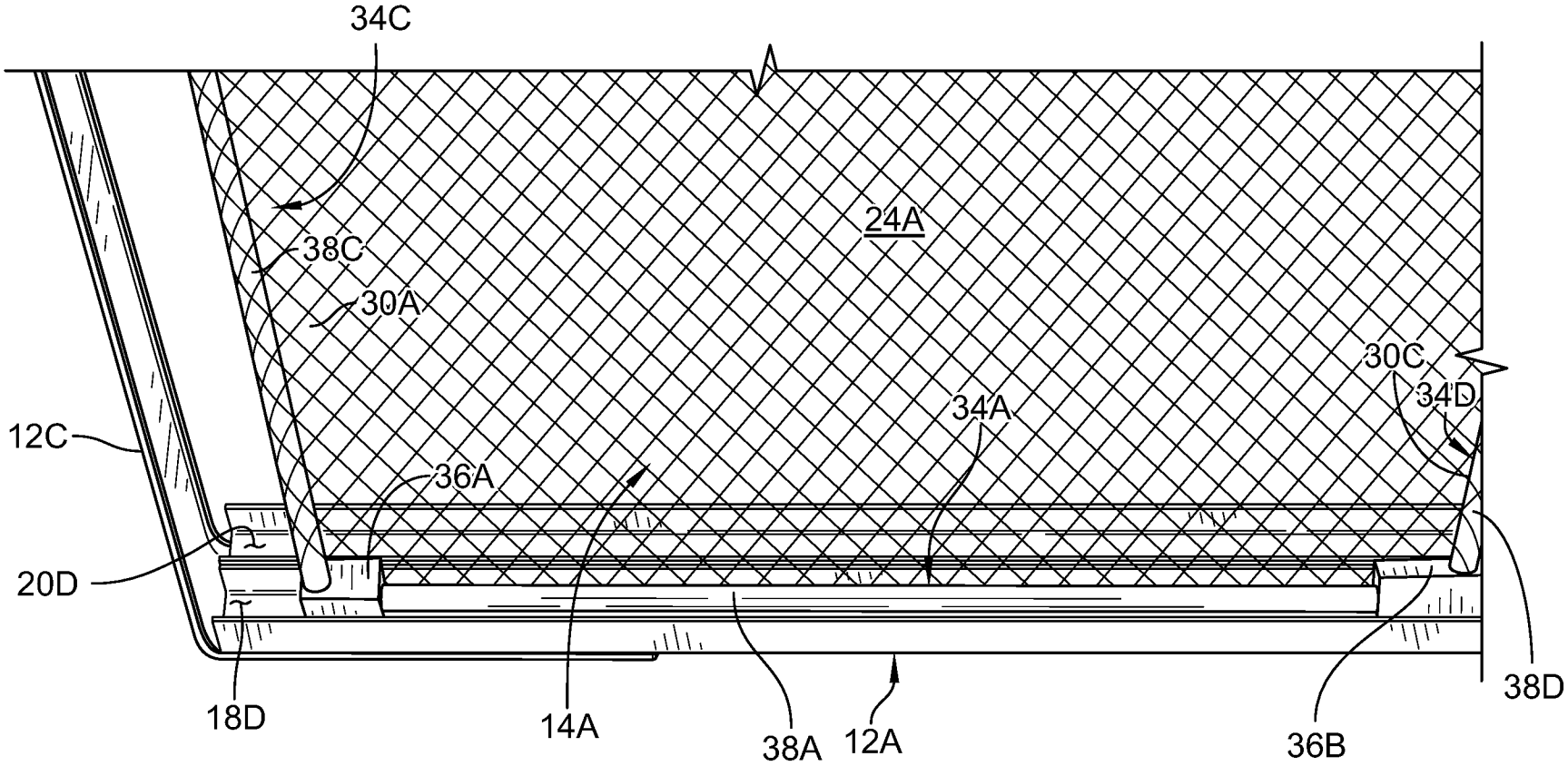
FIG. 3 is a magnified view similar to FIG. 2 depicting a bottom frame component of a framed panel of the cover assembly slidingly received within a front channel of the one rail of the dunnage container frame assembly.

Referring specifically now to FIG. 2, an embodiment is shown of the rail 12A. In the illustrated embodiment, the rail 12A is provided in the form of two side-by-side tracks 16A, 16B coupled together at least partially along their lengths, wherein the track 16A defines an outer track, i.e., furthest away from the interior of the dunnage container, and the track 16B defines an inner track, i.e., closest to the interior of the dunnage container. The outer track 16A includes two spaced-apart, upstanding, planar sidewalls 18A, 18B joined at one end by a planar bottom wall 18C to form a planar channel 18D between the sidewalls 18A, 18B, and the inner track 16B likewise includes two spaced-apart, upstanding, planar sidewalls 20A, 20B joined at one end by a planar bottom wall 20C to form a planar channel 20D between the sidewalls 20A, 20B. The inner sidewall 18B of the outer track 16A is illustratively parallel and in contact with the inner sidewall 20B of the inner track 16B. In some alternate embodiments, the sidewalls 18B, 20B may be spaced apart from one another. In other alternate embodiments, the sidewalls 18B, 20B may be merged into a single sidewall, and in some such embodiments the outer and inner tracks 16A, 16B may be provided in the form of a single, unitary bottom rail 12A defining side-by-side channels 18D, 20D each extending at least partially along the length of the rail 12A.

Figure 10:
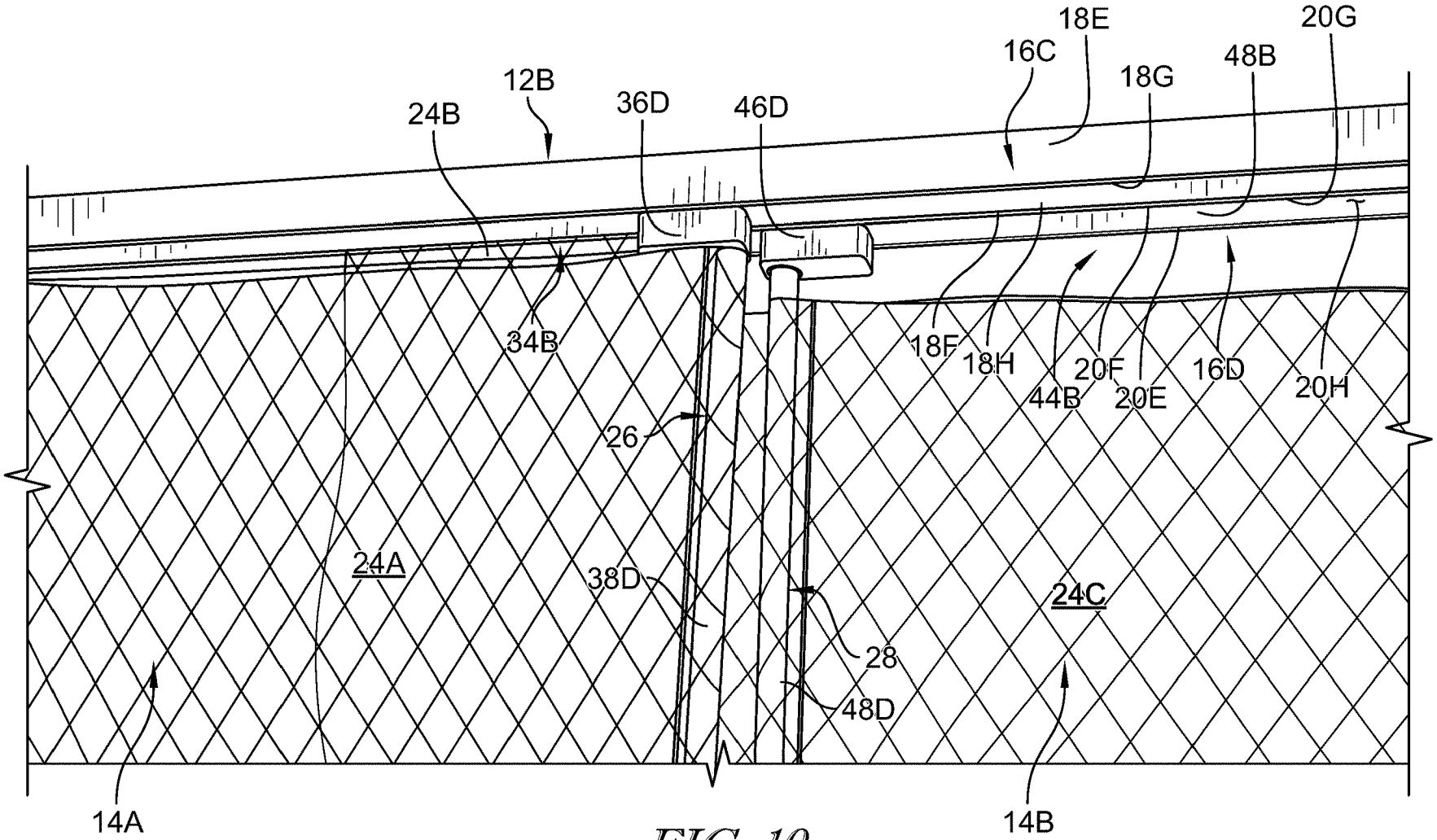
FIG. 10 is a magnified perspective view of the cover assembly with the panels thereof in the position shown in FIG. 9 illustrating the positions of the two framed panels of the cover assembly relative to the channels of a rail of the dunnage container frame assembly opposite that illustrated in FIGS. 2 and 3 and illustrating the flexible center panel at least partially trapped between the two framed panels.

Referring specifically now to FIG. 10, an embodiment is shown of the rail 12B. In the illustrated embodiment, the rail 12B is provided in the form of two side-by-side tracks 16C, 16D coupled together at least partially along their lengths, wherein the track 16C defines an outer track, i.e., furthest away from the interior of the dunnage container, and the track 16D defines an inner track, i.e., closest to the interior of the dunnage container. The outer track 16C includes two spaced-apart, upstanding, planar sidewalls 18E, 18F joined at one end by a planar wall 18G to form a planar channel 18H between the sidewalls 18E, 18F, and the inner track 16D likewise includes two spaced-apart, upstanding, planar sidewalls 20E, 20F joined at one end by a planar wall 20G to form a planar channel 20H between the sidewalls 20E, 20F. The inner sidewall 18F of the outer track 16C is illustratively parallel and in contact with the inner sidewall 20F of the inner track 16D. In some alternate embodiments, the sidewalls 18F, 20F may be spaced apart from one another. In other alternate embodiments, the sidewalls 18F, 20F may be merged into a single sidewall, and in some such embodiments the outer and inner tracks 16C, 16D may be provided in the form of a single, unitary rail 12B defining side-by-side channels 18H, 20H each extending at least partially along the length of the rail 12B.

Referring now to FIG. 1, the cover assembly 14 illustratively includes a flexible or semi-flexible sheet 24 coupled to and between two spaced-apart cover frame assemblies 26, 28 to form two spaced apart framed panels 24A, 24C with a flexible, redirectable panel 24B disposed and attached therebetween. The cover frame assembly 26 is illustratively a closed frame assembly, i.e., closed about its periphery, and is configured to slidably engage the outer tracks 16A, 16C of the opposed rails 12A, 12B respectively such that the frame assembly 26, and thus the framed panel 24A, is slidable, i.e., slidably movable, along the elongated channels 18D, 18H of the respective outer tracks 16A, 16C of the respective opposed rails 12A, 12B. A first portion of the sheet 24 at one end thereof is coupled to the cover frame assembly 26 to form the framed panel 24A. The cover frame assembly 28 is likewise illustratively a closed frame assembly, i.e., closed about its periphery, and is configured to slidably engage the inner tracks 16B, 16D of the opposed rails 12A, 12B respectively such that the frame assembly 28 is slidable, i.e., slidably movable, along the elongated channels 20D, 20H of the respective inner tracks 16B, 16D of the respective opposed rails 12A, 12B. A second portion of the sheet 24 at an opposite end thereof is coupled to the cover frame assembly 28 to form the framed panel 24C, and opposing sides of a third portion of the sheet 24 between the first and second portions is coupled to respective, opposing sides of the frame assemblies 26, 28 to form the flexible, redirectable panel 24B disposed and coupled between the framed panels 24A, 24C.

In the illustrated embodiment, the flexible or semi-flexible sheet 24 is implemented in the form of a single, translucent sheet. In some alternate embodiments, the sheet 24 may be formed of other flexible or semi-flexible materials which may be transparent, translucent, opaque or light-blocking. In other alternate embodiments, the sheet 24 may be formed of a combination of such materials, either over the entire body of the sheet 24 or in different sections of the body of the sheet 24. Examples of materials from which the sheet 24 may be formed illustratively include, but are not limited to, plastic, reinforced plastic, canvas, or the like. In any case, the material(s) from which the sheet 24 is formed will be flexible or semi-flexible at least in the region of the panel 24B such that the panel 24B will be redirected by sliding movement of one or both of the framed panels 24A, 24C so as to be trapped between the framed panels 24A, 24C as a portion or portions of the opening 50 is/are selectively exposed and so as to extend between the framed panels 24A, 24C as the opening 50 is closed, i.e., covered by the cover assembly 14.

While the flexible or semi-flexible sheet 24 is illustrated in the attached figures as being formed of a single sheet, it will be understood that in alternate embodiments the sheet 24 may be formed of multiple different sheets each attached to a respective one or both of the cover frame assemblies 26, 28. In one such alternate embodiment, for example, the sheet 24 may be provided in the form of three separate sheets; one attached only to the frame assembly 26, one attached only to the frame assembly 28 and the remaining sheet attached to and between each frame assembly 26, 28. In this embodiment, either or both of the sheets attached to the frame assemblies 26, 28 may be flexible, semi-flexible or rigid. In other embodiments, the sheet or portion of a sheet attached to the frame assembly 26, attached to the frame assembly 28 and/or attached to and between the frame assemblies 26, 28 may itself be made up of multiple layered and/or interconnected sheet members.

Referring now to FIGS. 1-5, the cover frame assembly 26 illustratively includes opposing frame members 34A, 34B respectively, and two additional opposing frame members 34C, 34D interconnected at their ends with corresponding ends of the opposed frame members 34A, 34B to form a closed frame assembly 26, i.e., closed about its periphery, which defines an opening therethrough between the frame members 34A-34D. In the illustrated embodiment, the frame member 34A includes opposed corner members 36A, 36B and an elongated support member 38A, e.g., in the form of a tube, rod or shaft, coupled at opposite ends thereof to the corner members 36A, 36B, and the frame member 34B likewise includes opposed corner members 36C, 36D and an elongated support member 38B, e.g., in the form of a tube, rod or shaft, coupled at opposite ends thereof to the corner members 36C, 36D. The frame member 34C includes another elongated support member 38C, e.g., in the form of a tube, rod or shaft, coupled at opposite ends to the corner members 36A, 36C, and the frame member 34D includes yet another elongated support member 38D, e.g., in the form of a tube, rod or shaft, coupled at opposite ends to the corner members 36B, 36D.

The corner members 36A, 36B are illustratively sized and configured to be received within the channel 18D of the rail 12A between the sidewalls 18A, 18B of the track 16A. The corner members 36A, 36B are configured to slide longitudinally along the channel 18D such that the corner members 36A, 36B are guided by the sidewalls 18A, 18B of the track 16A as the frame member 34A moves along the channel 18D. The corner members 36C, 36D are likewise sized and configured to be received within the channel 18H of the rail 12B between the sidewalls 18E, 18F of the track 16C (see also FIG. 10). The corner members 36C, 36D are configured to slide longitudinally along the channel 18H such that the corner members 36C, 36D are guided by the sidewalls 18E, 18F of the track 16C as the frame member 34B moves along the channel 18H.

Figure 4:
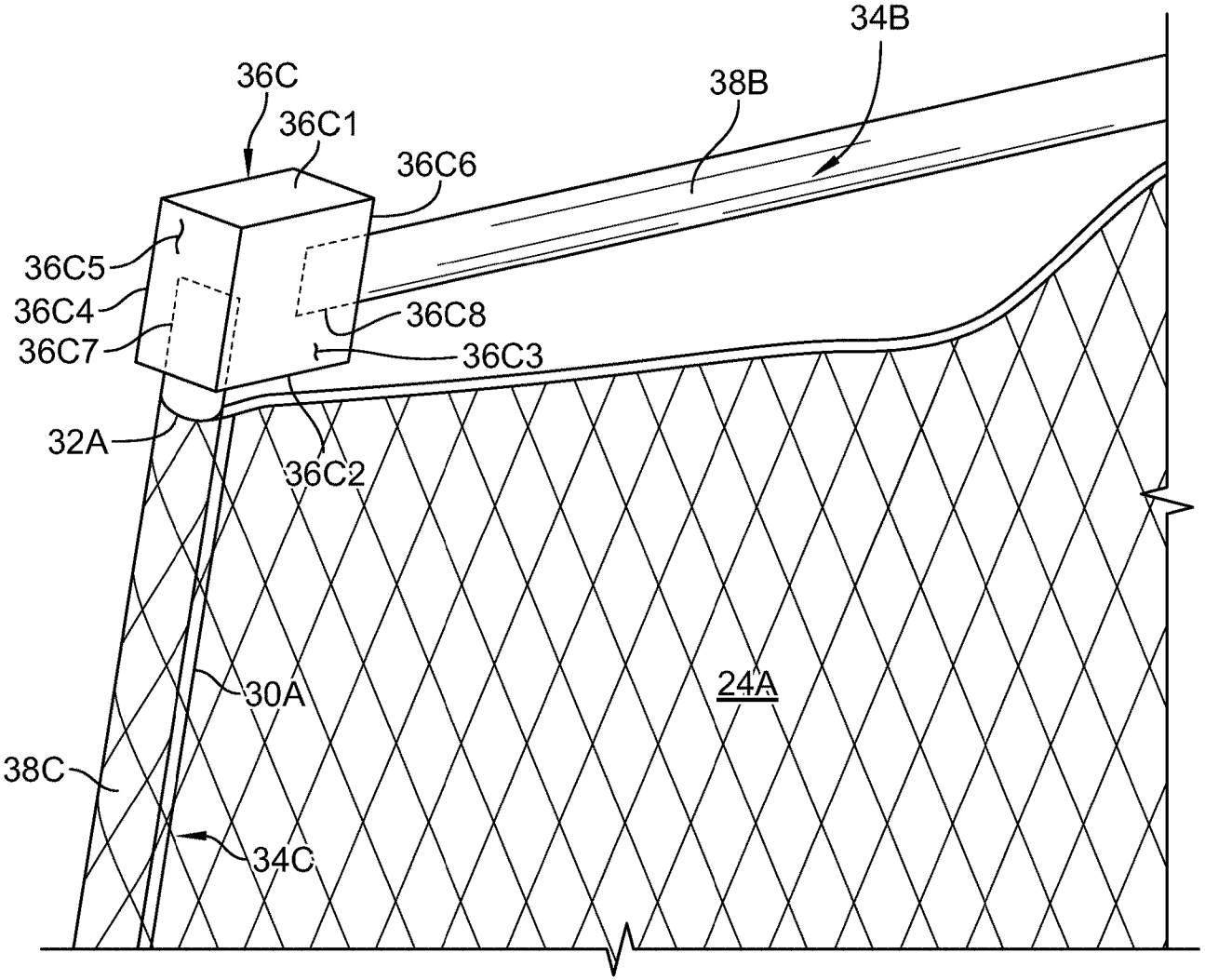
FIG. 4 is a magnified perspective view of one end of a frame component of the framed panel the sliding cover assembly illustrated in FIG. 3.

As best illustrated in FIG. 4, the corner member 36C is illustratively cube-shaped and includes a planar top surface 36C1 which slides along or adjacent to the planar wall 18G of the track 16C, a bottom surface 36C2 opposite the top surface 36C1 and opposite planar side walls 36C3, 36C4 each of which faces a respective sidewall 18E, 18F of the track 16C. Opposite end walls 36C5, 36C6 define the remaining faces of the corner member 36C. A bore 36C7 extends into the bottom surface 36C2 of the corner member 36C and is sized to receive one end of the elongated support member 38C therein. Another bore 36C8 extends into the end wall 36C6 and is sized to receive one end of the elongated support member 38B therein. In the illustrated embodiment, the corner member 36A is the mirror image of the corner member 36C and is coupled to the elongated support members 38C and 38A as just described with respect to the corner member 36C.

Figure 5:
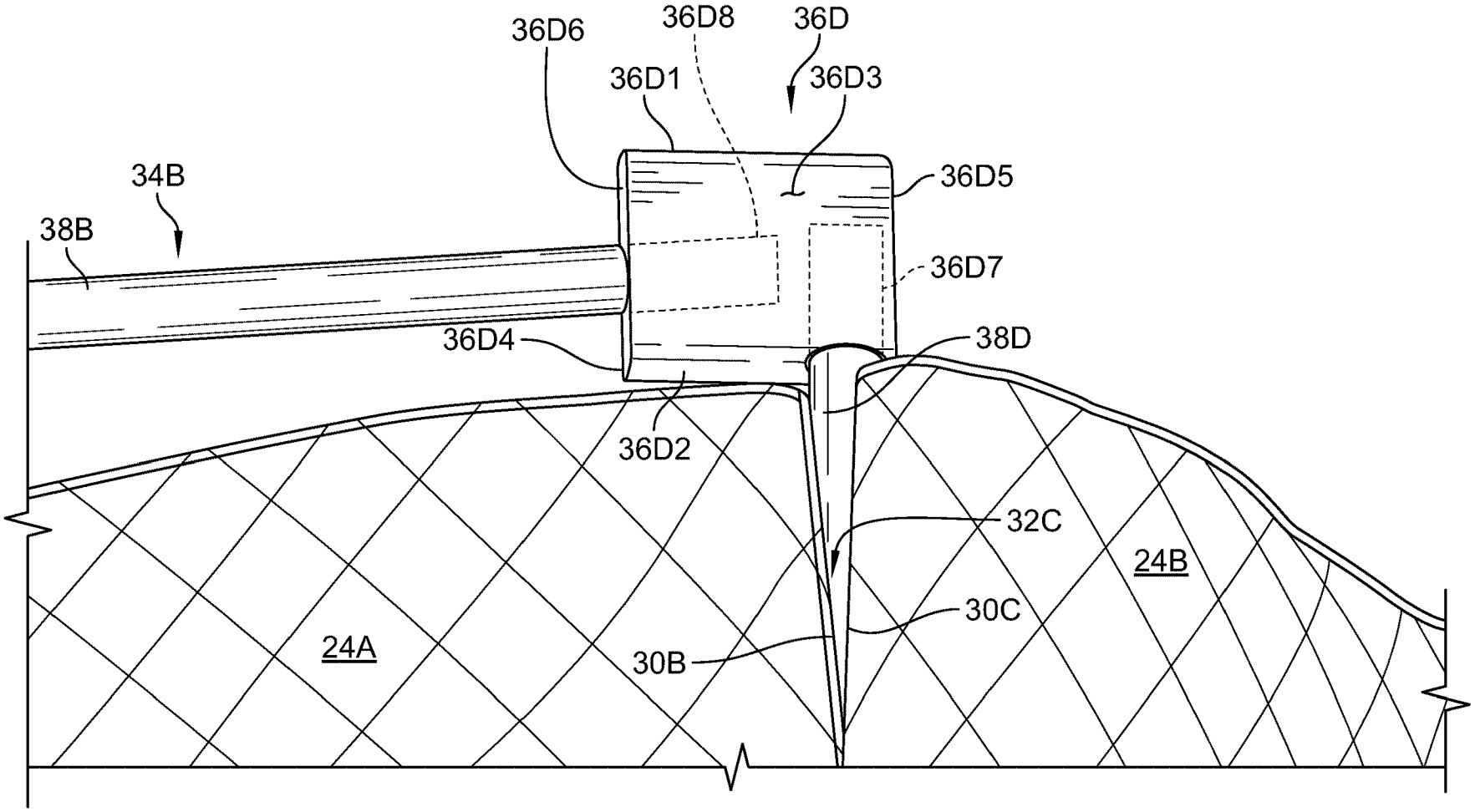
FIG. 5 is a magnified front elevational view of the opposite end of the frame component illustrated in FIG. 4.

As best illustrated in FIG. 5, the corner member 36D is also illustratively cube-shaped and includes a planar top surface 36D1 which slides along or adjacent to the planar wall 18G of the track 16C, a bottom surface 36D2 opposite the top surface 36D1 and opposite planar sidewalls 36D3, 36D4 each of which faces a respective sidewall 18E, 18F of the track 16C. Opposite end walls 36D5, 36D6 define the remaining faces of the corner member 36D. A bore 36D7 extends into the bottom surface 36D2 of the corner member 36D and is sized to receive one end of the elongated support member 38D therein. Another bore 36C8 extends into the end wall 36D6 and is sized to receive the opposite end of the elongated support member 38B therein. In the illustrated embodiment, the corner member 36B is the mirror image of the corner member 36D and is coupled to the elongated support members 38D and 38A as just described with respect to the corner member 36D.

Figure 6:
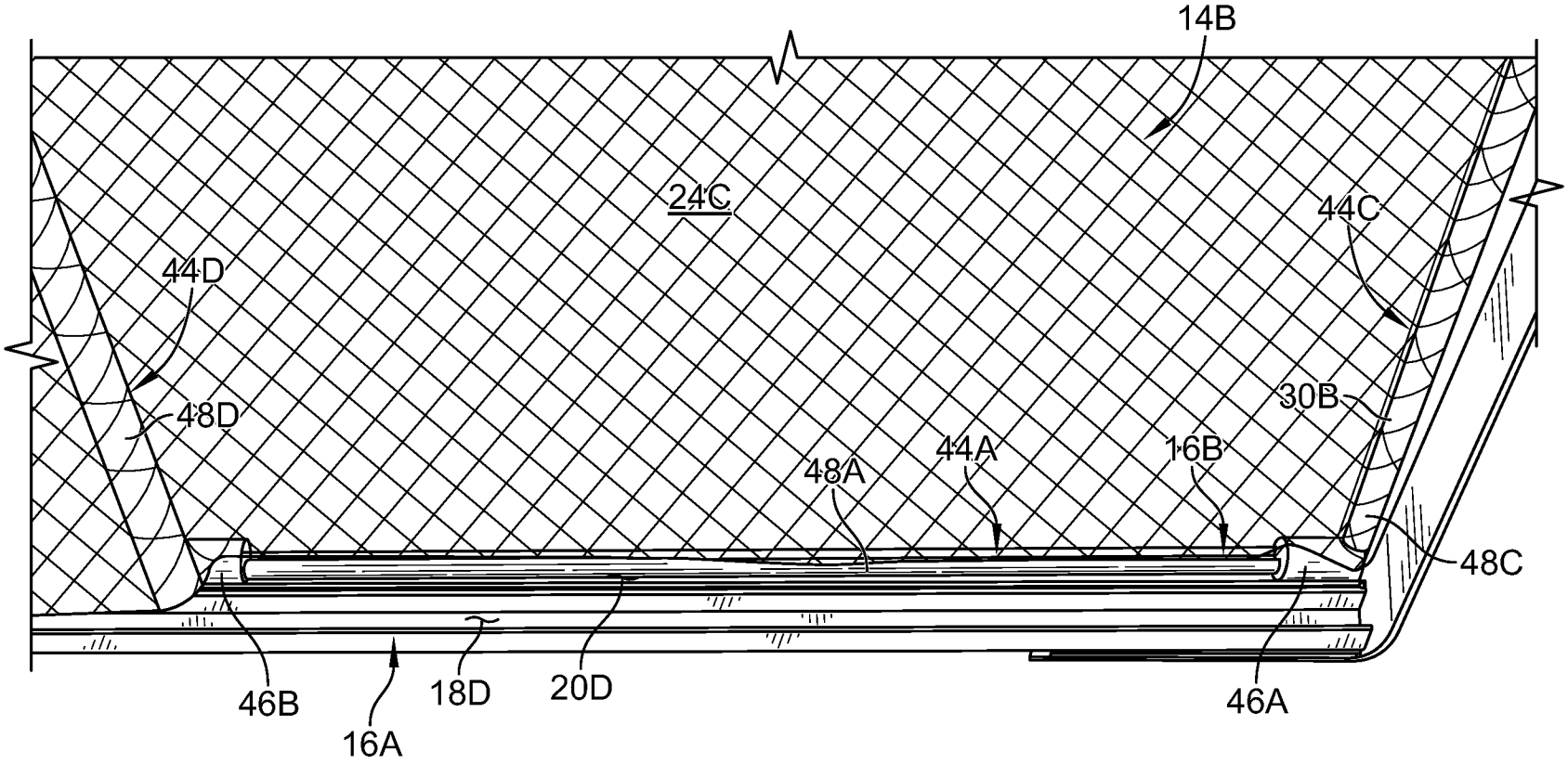
FIG. 6 is a magnified perspective view of a portion of the one rail adjacent to a side of the dunnage container frame assembly opposite to that illustrated in FIG. 2 depicting a bottom frame component of another framed panel of the cover assembly slidingly received within a rear channel of the one rail.

Referring now specifically to FIGS. 1, 6 and 10, the cover frame assembly 28 is illustratively identical to the cover frame assembly 26 just described. For example, the frame assembly 28 illustratively includes opposed frame members 44A, 44B respectively, and two additional opposed members 44C, 44D interconnected at each end with respective ends of the opposed frame members 44A, 44B to form a closed frame assembly 28, i.e., closed about its periphery, which defines an opening therethrough between the frame members 44A-44D. The frame member 44A includes opposed corner members 46A, 46B and an elongated support member 48A, e.g., in the form of a tube, rod or shaft, coupled at opposite ends thereof to the corner members 46A, 46B, and the frame member 44B likewise includes opposed corner members 46C, 46D and an elongated support member 48B, e.g., in the form of a tube, rod or shaft, coupled at opposite ends thereof to the corner members 46C, 46D. One frame member 44C includes another elongated support member 48C, e.g., in the form of a tube, rod or shaft, coupled at opposite ends to the corner members 46A, 46C, and the other frame member 44D includes yet another elongated support member 48D, e.g., in the form of a tube, rod or shaft, coupled at opposite ends to the corner members 46B, 46D.

The corner members 46A-46D are illustratively sized and configured to be received within the channel 20D of the rail 12A between the sidewalls 20A, 20B of the track 16B. The corner members 46A, 46B are configured to slide longitudinally along the channel 20D such that the corner members 46A, 46B are guided by the sidewalls 20A, 20B of the track 16B as the frame member 44A moves along the channel 20D. The corner members 46C, 46D are likewise sized and configured to be received within the channel 20H of the rail 12B between the sidewalls 20E, 20F of the track 16D (see also FIG. 10). The corner members 46C, 46D are configured to slide longitudinally along the channel 20H such that the corner members 46C, 46D are guided by the sidewalls 20E, 20F of the track 16D as the frame member 44B moves along the channel 20H. The corner members 46A-46D are illustratively shaped and coupled to respective ones of the elongated support members 48A-48D as described above with respect to the corner members 36A-36D and respective elongated support members 38A, 38D.

Figure 8:
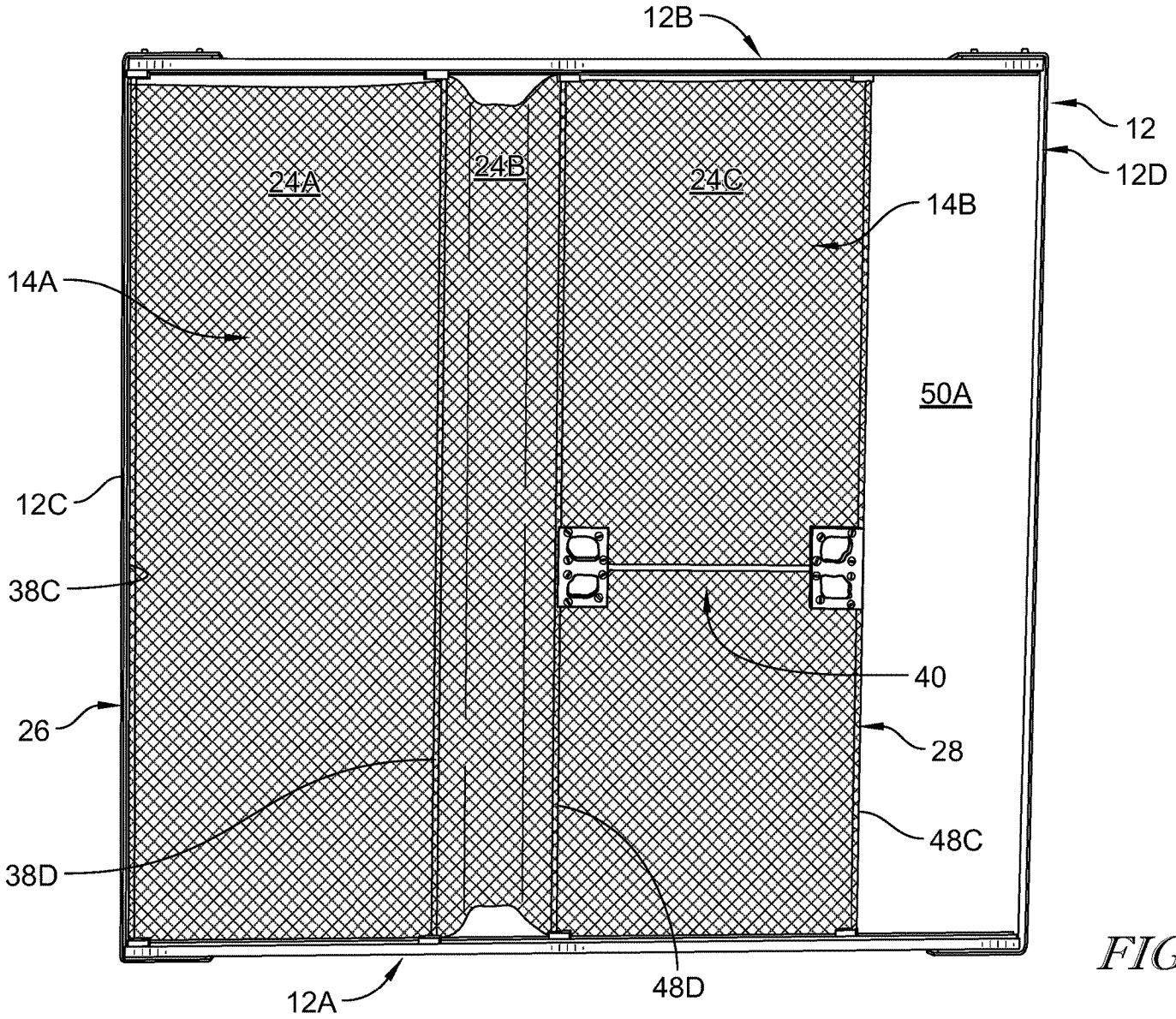
FIG. 8 is a front elevational view similar to FIG. 1 depicting one of the framed panels of the cover assembly slidingly displaced along respective channels of the opposed rails to expose a portion of the opening of the dunnage container frame assembly and, in the process of sliding, partially folding the flexible center panel.
Figure 9:
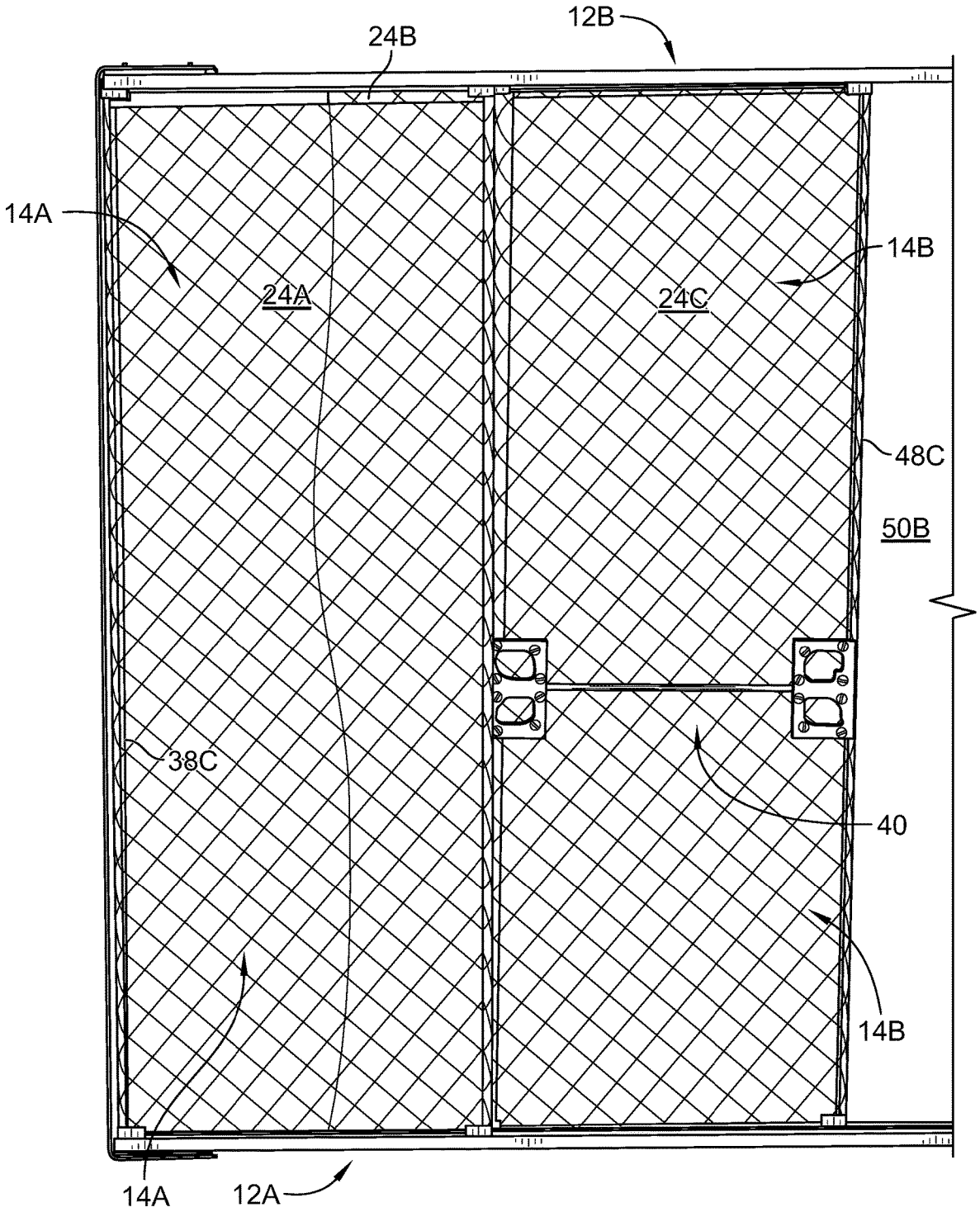
FIG. 9 is a front elevational view similar to FIG. 8 showing the framed panel of the cover assembly further displaced along respective channels of the opposed rails to expose a greater portion of the opening of the dunnage container frame assembly and, in the process of further sliding, redirecting the flexible center panel to at least partially trap the flexible center panel between the two framed panels.
Figure 11:
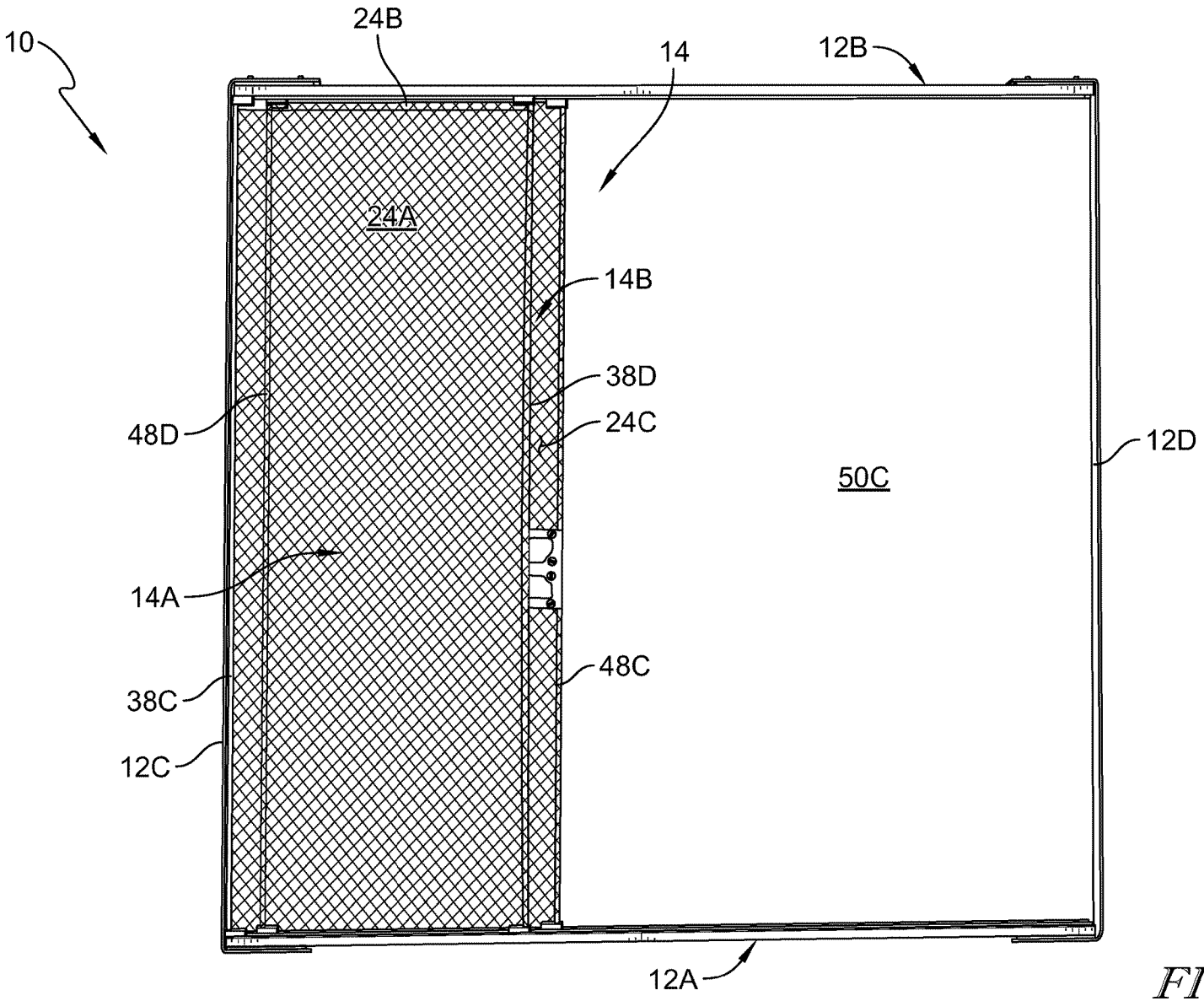
FIG. 11 is a front elevational view similar to FIGS. 1, 8 and 9 showing the framed panel of the cover assembly fully displaced along respective channels of the opposed rails to expose an even greater portion of the opening of the dunnage container frame assembly and, in the process of further sliding, further redirecting the flexible center panel to trap the flexible center panel between the two framed panels.

As illustrated by example in FIGS. 8, 9 and 11 in which orientation of the frame assembly 12 depicted therein represents an open side or open top to a dunnage container, the frame assembly 26 is mounted to the frame assembly 12 such that the framed panel 24C slides behind or beneath the framed panel assembly 24A as the framed panel assembly 24C slides toward a stationary framed panel assembly 24A (or as the framed panel assemblies 24A, 24C move toward each other). Conversely, as the framed panel assembly 24A slides toward a stationary framed panel assembly 24C, the framed panel 24A will slide in front of or over the framed panel assembly 24C (or as the framed panel assemblies 24A, 24C move toward each other). In either case, the flexible panel 24B is redirected by such movement of the framed panel assembly 24A and/or the framed panel assembly 24C to become progressively trapped between the two framed panel assemblies 24A, 24C as a greater area (or areas) of the opening 50 of the dunnage container is/are exposed, and to progressively extend between the two framed panel assemblies 24A, 24C as the opening 50 of the dunnage container is closed or covered by the sliding cover assembly 14. As illustrated by example in FIG. 1, the widths of the framed panels 24A, 24C and of the flexible panel 24B are substantially equal to one another, although in other embodiments the width of the flexible panel 24B may be greater or less than those of the framed panels 24A, 24C, and is still other embodiments the framed panels 24A, 24C may be of different widths and the width of the flexible panel 24B may be approximately the same as one of the frame panels 24A, 24C or different from the widths of each of the framed panels 24A, 24C. In any case, the widths of the framed panels 24A, 24C and the width of the flexible panel 24B are illustratively selected such that, with the flexible panel 24B fully extended between the framed panels 24A, 24C, the framed panels 24A, 24C and the flexible panel 24B together cover the opening 50 of the dunnage container as illustrated by example in FIG. 1.

In the illustrated embodiment, the elongated support members 38A-38D and 48A-48D are each provided in the form of a semi-flexible plastic rod or shaft. The semi-flexible nature of at least some of the elongated support members 38A-38D and 48A-48D can be advantageous in some embodiments in that this will resist breakage and/or allow for rapid removal and installation of the frame assemblies 26, 28, e.g., for replacement of the sheet 24 and/or replacement of one or more frame components and/or for cleaning of the channels 18D, 20D and 18H, 20H respectively. In some embodiments one or more of these advantages may be realized by providing only the elongated support members 38C, 38D and 48C, 48D in the form of semi-flexible members while the elongated support members 38A, 38B and 48A, 48B may be rigid, or vice versa. In still other alternate embodiments, some or all of the elongated support members 38A-38D, 48A-48D may be rigid.

It will be understood that the channeled rails 12A, 12B are provided only by way of example, and that this disclosure contemplates alternate embodiments which include channelless rails 12A, 12B. In some such embodiments, the corner members 36A-36D, 46A-46D may be designed to slidingly engage the rails 12A, 12B without implementing elongated, cover frame-engaging channels. In other embodiments, the elongated support members 38A, 38B and 48A, 48B may additionally or alternatively designed to slidingly engage the rails 12A, 12B without implementing elongated, cover frame-engaging channels. In some such embodiments, the corner members 36A-36D and/or 46A-46D may be omitted, and the ends of the elongated support members 38A-38D and 48A-48D may be configured to be operatively coupled to one another, e.g., detachably or otherwise.

Referring now to FIGS. 1 and 3-7, the flexible sheet 24 is illustratively provided in the form of a single sheet, as briefly described above, although in alternate embodiments the sheet 24 may be provided in the form of multiple sheets or strips attached to one another and/or to the cover frame assemblies 26, 28. In the illustrated embodiment, one end 30A of the sheet is folded back and attached to the sheet 24 to form an elongated loop 32A through which the elongated support member 38C passes, and the opposite end 30B of the sheet is likewise folded back and attached to the sheet 24 to form another elongated loop 32B through which the elongated support member 48C passes. Opposing surfaces 30C, 30D of the sheet 24 on either side of the elongated support member 38D are affixed to one another at least partially along the length of the sheet 24 to form another elongated loop 32C through which the elongated support member 38D passes, and opposing surfaces 30E, 30F of the sheet 24 on either side of the elongated support member 48D are likewise affixed to one another at least partially along the length of the sheet 24 to form yet another elongated loop 32D through which the elongated support member 48D passes. In the illustrated embodiment, a planar end 30G of the sheet 24 extends along the rail 12A adjacent to, but not connected to, the frame members 34A, 44A, and a planar end 30H of the sheet 24 extends along the rail 12B adjacent to, but not connected to, the frame members 34B, 44B. In alternate embodiments, the end 30G of the sheet 24 may be coupled to either or both of the frame members 34A, 44A and/or the end 30H of the sheet 24 may be coupled to either or both of the frame members 34B, 44B.

The sheet 24, whether provided in the form of a single, unitary sheet affixed in places at least to the elongated frame members 38C, 38D, 48C, 48D of the respective cover frame assemblies 26, 28, or provided in the form of multiple separate sheets affixed to one another or each separately affixed to and between respective ones of the elongated frame members 38C, 38D, 48C, 48D, forms two spaced apart framed panels 24A, 24C separated by, and attached to respective opposite ends of, a flexible, center panel 24B, The heights of the framed panels 24A, 24C and of the flexible panel 24B each illustratively span, or nearly span, the length of the opening 50 of the dunnage container frame assembly 12 defined between the opposed surfaces of the rails 12A, 12B. The two outer panel frames 24A, 24C form slidable, framed panels each slidable along and relative to the rails 12A, 12B, and the middle or center panel of the sheet 24 forms a flexible panel 24B having opposite sides attached to, or integral with, opposing sides of the framed panels 24A, 24C. When the cover assembly 14 is fully deployed over the opening 50 of the dunnage container, as illustrated by example in FIG. 1, an outer side of the framed panel 24A is positioned at or adjacent to the frame member 12C of the dunnage container frame assembly 12, an outer side of the framed panel 24C is positioned at or adjacent to the frame member 12D of the dunnage container frame assembly 12, and the framed panels 24A, 24C and the flexible panel 24B extend side-by-side laterally across the width of the opening 50 of the dunnage container frame assembly 12 defined between opposed surfaces of the side frame members 12C, 12D. In the fully deployed position illustrated in FIG. 1, the framed panels 24A, 24C and the flexible panel 24B are at least approximately planar and coplanar with one another, and the combination of the framed panels 24A, 24C and the flexible panel 24B is likewise at least approximately planar.

Figure 7:
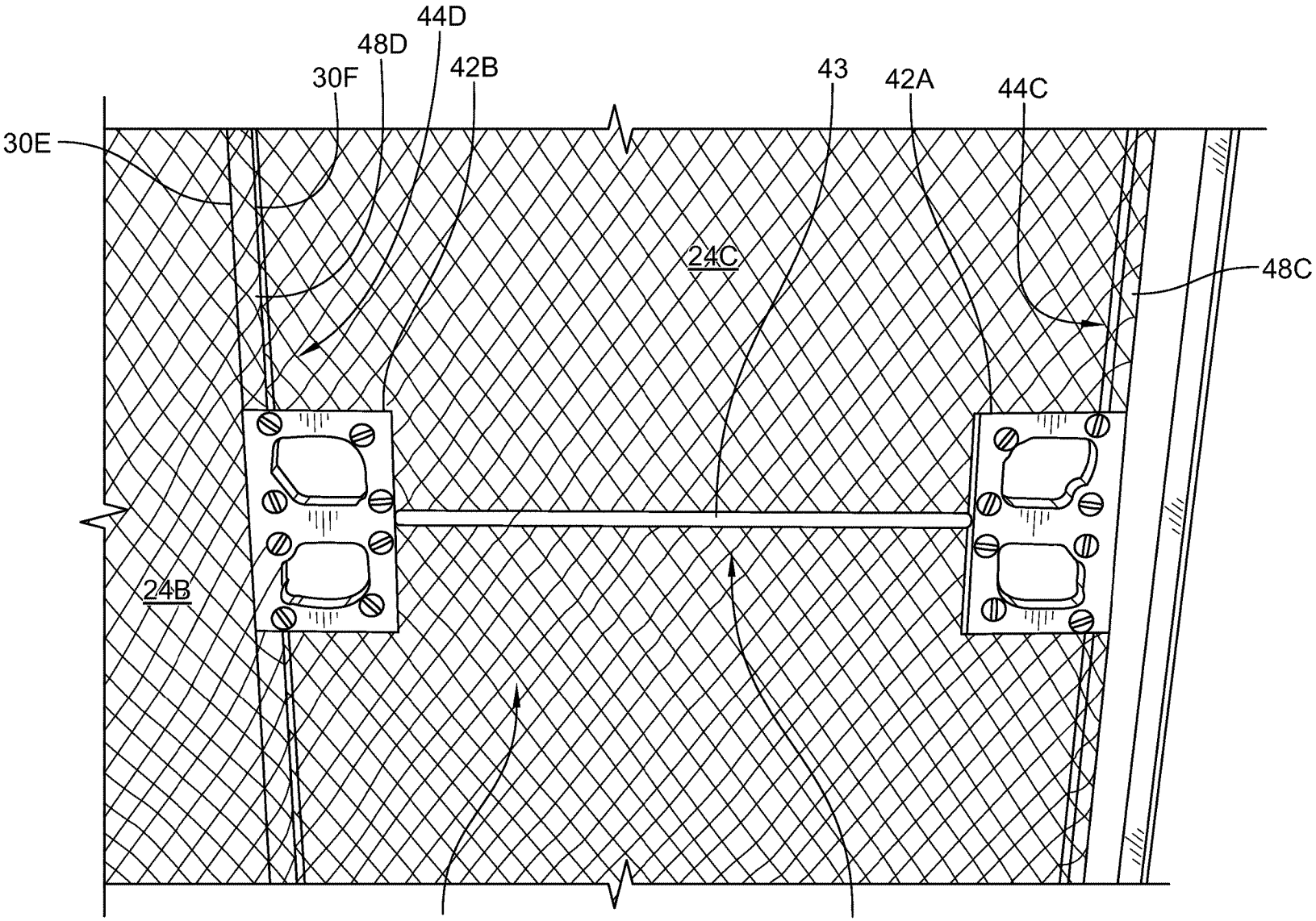
FIG. 7 is a magnified view of a portion of the cover assembly depicting a handle assembly mounted to the frame assembly of the framed panel illustrated in FIG. 6.

In some embodiments, the cover assembly 14 may include one or more handles or other engagement structures to facilitate sliding movement of one or both of the framed panels 24A, 24C along the opposed rails 12A, 12B, i.e., to facilitate selective exposing or covering of portions of the dunnage container opening 50. Referring to FIGS. 1 and 7, an example embodiment of one such handle 40 is shown affixed to the framed panel 24C approximately mid-way between the opposite ends thereof. In the illustrated embodiment, the handle 40 includes a slotted handle grip 42A affixed to the elongated frame member 48C, another slotted handle grip 42B affixed to the elongated frame member 48C and an elongated support member 43, e.g., in the form of a tube, rod or shaft, extending laterally between and affixed to each of the handle grips 42A, 42B. In alternate embodiments, the handle 40 may be affixed to the framed panel 24A, and is still other embodiments a handle 40 may be affixed to each of the framed panels 24A, 24C. In any such embodiment(s), multiple handles 40 may be affixed to either or both of the framed panels 24A, 24C, e.g., spaced apart along the length of the respective framed panel(s) 24A, 24C.

Figure 12:
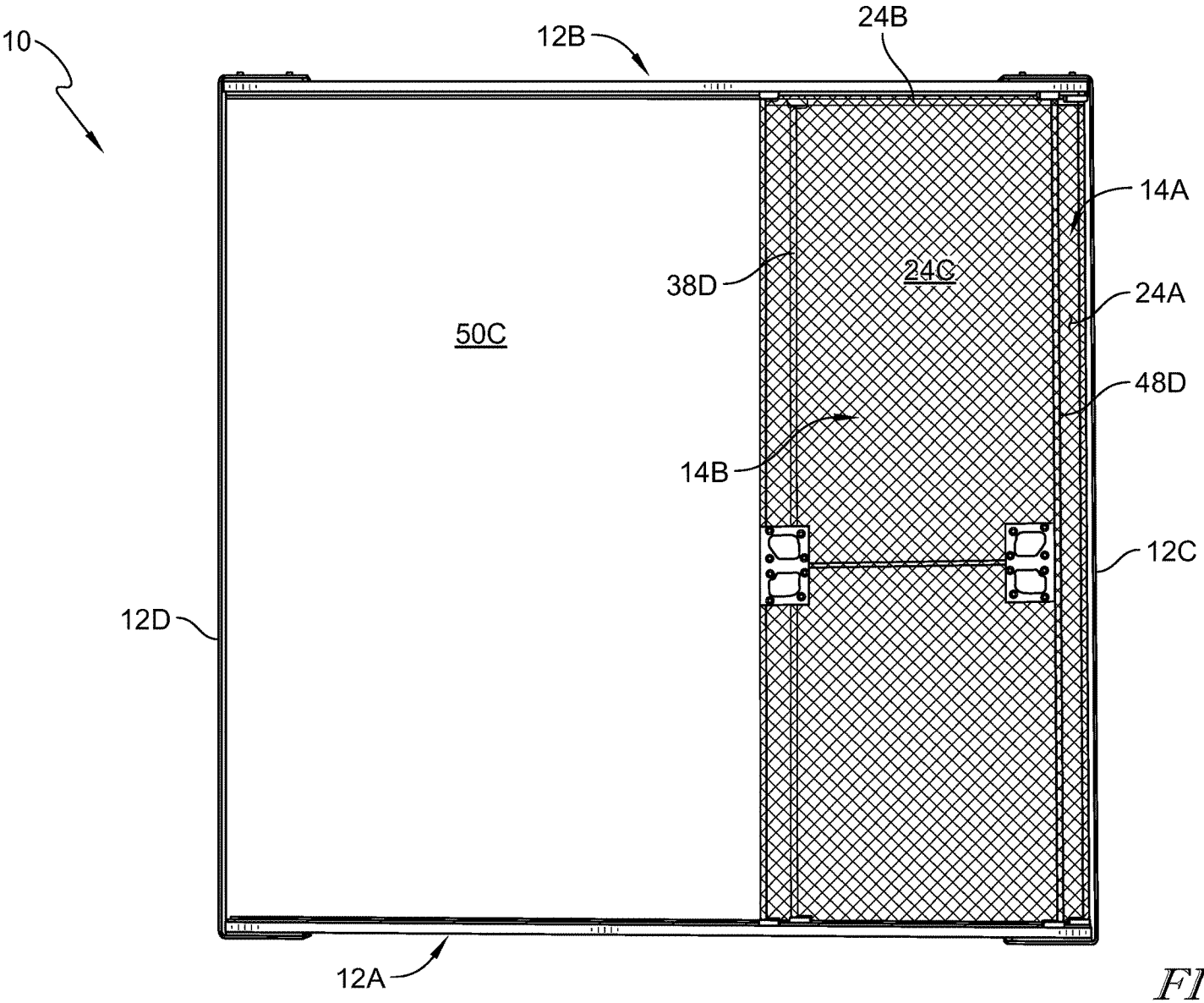
FIG. 12 is a rear elevational view illustrating the dunnage container frame assembly with the cover assembly panels in the positions illustrated in FIG.

Referring now to FIGS. 1 and 8-12, operation of one side of the dunnage container cover assembly 14 is illustrated. With the cover assembly 14 in its fully deployed position as illustrated in FIG. 1, the cover panel 14B is illustratively moved toward the cover panel 14A to expose a portion 50A of the dunnage container opening 50 as illustrated by example in FIG. 8. In so doing, the cover panel 14A remains stationary but the flexible or semi-flexible center panel 24B at least partially folds as a result of the sliding lateral movement of the cover panel 14B relative to the opposed rails 12A, 12B. As lateral movement of the cover panel 14B toward the cover panel 14A continues the cover panel 14B advances sufficiently toward the cover panel 14A such that the cover panel 14B begins to pass behind the cover panel 14A while exposing a greater portion 50B of the dunnage container opening 50 as illustrated by example in FIGS. 9 and 10. As a result of such lateral movement of the cover panel 14B, the flexible or semi-flexible center panel 24B is redirected by the cover panel 14B toward the opposite side of the cover panel 14A to which the flexible panel 24B attached so as to become at least partially trapped between the cover panels 14A, 14B. As leftward lateral movement of the cover panel 14B continues, the cover panel 14B moves behind the cover panel 14A such that the cover panels 14A, 14B overlay one another so as to expose an even greater portion 50C of the dunnage container opening 50 as illustrated in FIGS. 11 and 12. Such movement of the cover panel 14B relative to the cover panel 14A advances the elongated frame member 48D of the cover panel 14B toward the frame member 12C and away from the elongated frame member 38D of the cover panel 14A, thereby fully trapping the flexible or semi-flexible center panel 24B between the overlain cover panels 14A, 14B.

It will be understood that with the cover assembly 14 in its fully deployed position as illustrated in FIG. 1, the cover panel 14A may instead be advanced toward and in front of the cover panel 14B similarly as just described with respect to FIGS. 1 and 8-12 such that the cover panel 14A passes in front of the cover panel 14B. Alternatively, with each cover panels 14A, 14B moved laterally away from its respective frame member 12C, 12D, either or both of the cover panels 14A, 14B may be moved laterally along the opposed rails 12A, 12B to expose any desired portions of the dunnage cover opening 50.

Figure 13:
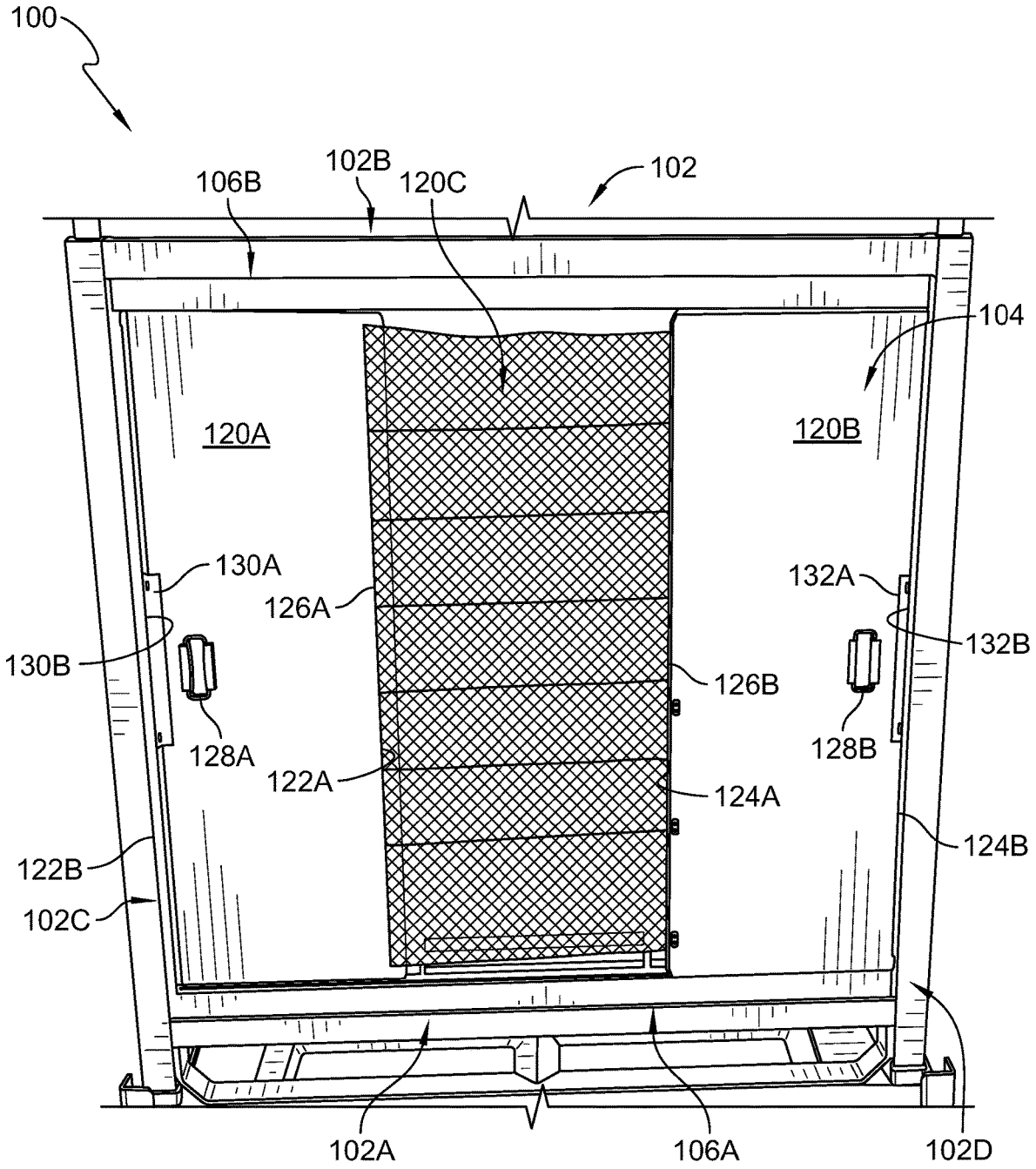
FIG. 13 is a front elevational view of another embodiment of a sliding cover assembly operatively mounted to a closed frame assembly representing an open top or side of a conventional top-loading or side-loading dunnage container.
Figure 14:
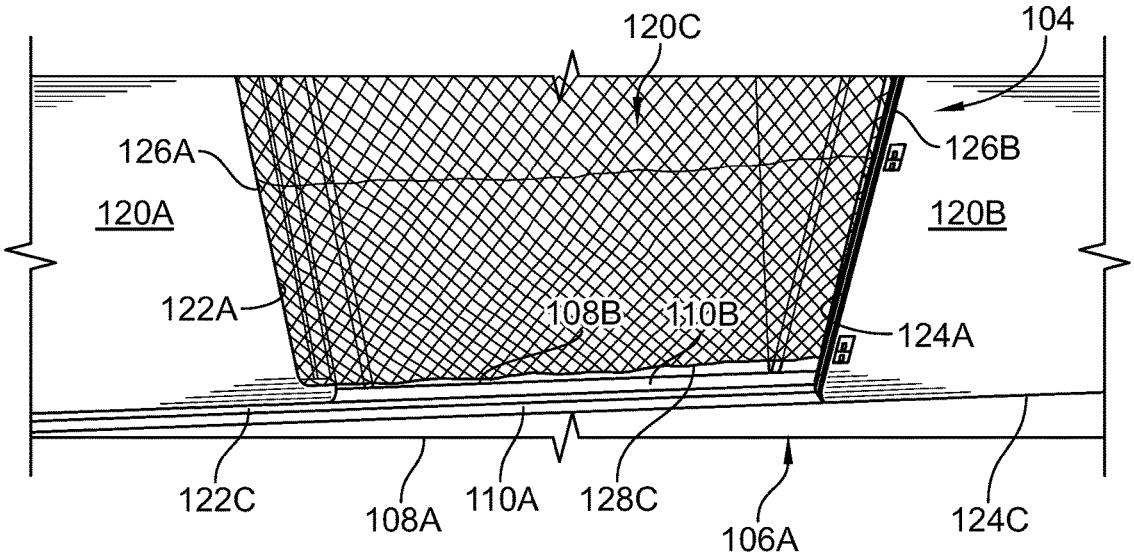
FIG. 14 is a magnified view of a portion of the bottom rail of the frame assembly of the dunnage container illustrated in FIG. 13 showing two spaced-apart side panels each slidable within a respective channel of one rail of the dunnage container and a flexible panel disposed and attached between the two side panels.
Figure 15:
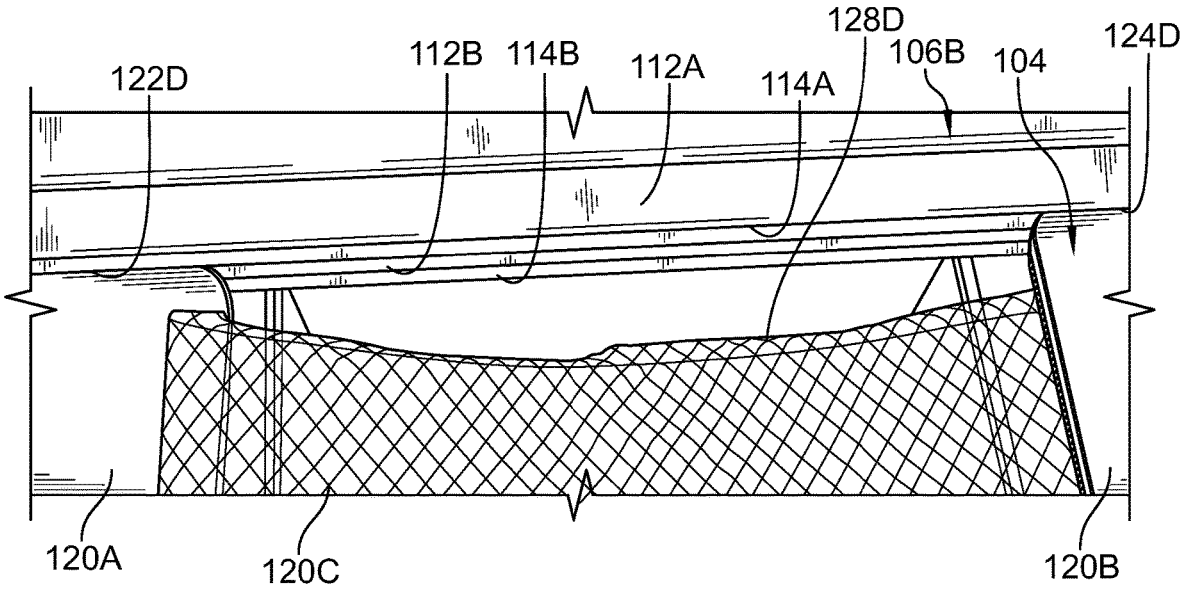
FIG. 15 is a magnified view of a portion of the rail of the frame assembly of the dunnage container illustrated in FIG. 13 showing the two spaced-apart side panels each slidable within a respective channel of the a rail of the dunnage container opposite that illustrated in FIG. 14 and with the flexible panel disposed and attached therebetween.

Referring now to FIGS. 13-15, another embodiment is shown of a dunnage container closure arrangement 100 including a sliding cover assembly 104 operatively mounted to a closed, dunnage container frame assembly 102. The dunnage container frame assembly illustratively includes four frame members 102A-102D interconnected with one another to form a top or side opening in an otherwise closed dunnage container as described above with respect to FIGS. 1-12. An elongated rail structure or assembly 106A is attached to one surface of the frame member 102A, and an opposed elongated rail structure 106B is attached to a surface of the rail member 102B such that the rails structures 106A, 106B face one another.

In the illustrated embodiment, the rail structure 106A includes side-by-side, elongated rails 108A, 108B attached to the inner surface of the frame member 102A such that the rails 108A, 108B extend longitudinally along the frame member 102A and laterally across the opening of the dunnage container. In alternate embodiments, the rails 108A, 108B may form the frame member of the dunnage container, i.e., such that the frame member 102A may be omitted. In any case, the rail 108A defines an elongated channel 110A between spaced-apart, upwardly extending walls of the rail 108A, and the channel 110A illustratively runs the length of the rail 108A. The rail 108B likewise defines an elongated channel 110B between spaced-apart, upwardly extending walls of the rail 108B, and the channel 110B illustratively runs the length of the rail 108B.

The rail structure 106B likewise includes side-by-side, elongated rails 112A, 112B attached to the inwardly-facing surface of the frame member 102A such that the rails 112A, 112B extend longitudinally along the frame member 102B and laterally across the opening of the dunnage container. In alternate embodiments, the rails 112A, 1128 may form the frame member of the dunnage container, i.e., such that the frame member 102B may be omitted. In any case, the rail 112A defines an elongated channel 114A between spaced-apart, downwardly extending walls of the rail 112A, and the channel 114A illustratively runs the length of the rail 112A. The rail 1088 likewise defines an elongated channel 1148 between spaced-apart, downwardly extending walls of the rail 1128, and the channel 1148 illustratively runs the length of the rail 1128. The channel 110A is directly opposite the channel 114A, and the channel 1108 is directly opposite the channel 114B.

The sliding cover assembly 104 is similar in many respects to the sliding cover assembly 14 illustrated in FIGS. 1-13 in that the cover assembly 104 includes two spaced-apart cover panels 120A, 1208 slidably received within respective channels of the opposed rail structures 106A, 1068 respectively, and a flexible panel 120C coupled to and between the cover panels 120A, 1208. The cover panel 120A has an inwardly-facing side 122A, an outwardly-facing side 122B opposite the inwardly-facing side 122A, one end 122C and an opposite end 122D opposite the end 122C, and the cover panel 1208 likewise has an inwardly-facing side 124A, an outwardly-facing side 124B opposite the inwardly-facing side 124A, one end 124C and an opposite end 124D opposite the end 124C. One side 126A of the flexible panel 120C is attached to the inwardly-facing side 122A of the cover panel 120A, and an opposite side 1268 of the flexible panel 120C is attached to the inwardly-facing side 124A of the cover panel 1208.

The end 122C of the cover panel 120A is received within, and is slidable along, the channel 1108 of the rail 1088, and the end 124C of the cover panel 1208 is received within, and is slidable along, the channel 110A of the rail 108A. The end 122D of the cover panel 120A is received within, and is slidable along, the channel 114B of the rail 1128, and the end 124D of the cover panel 1208 is received within, and is slidable along, the channel 114A of the rail 112A. The cover panel 1208 thus slides in front of the cover panel 120A as the cover panel 1208 is moved along the channels 110A, 114A toward and over the cover panel 120A, and the cover panel 120A slides behind the cover panel 1208 as the cover panel 120A is moved along the channels 1108, 1148 toward and behind the cover panel 1208. In any case, movement of the cover panel 120A and/or the cover panel 1208 to expose portion(s) of the opening of the dunnage container redirects the flexible panel 120C and traps the flexible panel 120C between the cover panels 120A, 120B as described above with respect to FIGS. 1-12.

In the illustrated embodiment, the cover panels 120A, 1208 are provided in the form of rigid or semi-rigid panels each with sufficient strength and rigidity to be self-supporting. As such, frame assemblies, such as the frame assemblies 26, 28 described above, are not needed and may therefore be omitted. In some embodiments, the cover panels 120A, 1208 may illustratively be provided in the form of conventional, two-foil plastic panels with ribbed or other support structures attached and extending between opposed faces of two planar foils. Such panels may illustratively be formed of, for example, polypropylene, although other materials may alternatively be used. Such panels are sometimes referred to in the industry as plastic corrugated panels. In alternate embodiments, either or both cover panels 120A, 1208 may be provided in the form of other conventional rigid or semi-rigid panels each with sufficient strength and rigidity to be self-supporting but otherwise without limitation. The flexible panel 120A may be as described above with respect to FIGS. 1-12.

In some embodiments, either or both of the cover panels 120A, 1208 may include handles for facilitating sliding movement thereof. In the embodiment illustrated in FIG. 13, for example, each of the cover panels 120A, 1208 includes a respective handle 128A, 1288 mounted thereto adjacent to, yet spaced apart from, the respective outwardly-facing side 122B, 124B thereof. In the illustrated embodiment, suitable openings are formed through the cover panels 120A, 1208, and the handles 128A, 1288 are configured to be received within the openings and secured to the respective cover panel 120A, 1208.

In some embodiments, either or both of the cover panels 120A, 1208 may be provided with panel locking, latching or securing structures for releasably securing the panel 120A, 1208 to a respective one of the frame members 102C, 102D of the dunnage container and/or for releasably locking the panels 120A, 1208 relative to one another in their spaced apart positions in which the panels 120A-120C completely or nearly cover the opening of the dunnage container. In the embodiments illustrated in FIG. 13, for example, a hook-and-loop fabric 130A is attached to and about the outwardly-facing side 1228 of the cover panel 120A, and a similar hook-and-loop fabric 132A is attached to and about the outwardly-facing side 124B of the cover panel 120B. A complementarily configured hook-and-loop fabric 130B is attached to and about the frame member 102C of the dunnage container, and the complementary hook-and-loop fabrics 130A, 130B are configured to engage one another on contact to releasably secure the outwardly-facing side 122B of the cover panel 120A to the frame member 102C. Likewise, a complementarily configured hook-and-loop fabric 132B is attached to and about the frame member 102D of the dunnage container, and the complementary hook-and-loop fabrics 132A, 132B are configured to engage one another on contact to releasably secure the outwardly-facing side 124B of the cover panel 120B to the frame member 102D, all as illustrated by example in FIG. 13. Those skilled in the art will recognize other conventional locking, latching or securing structures for releasably securing the panel 120A to the frame member 102C of the dunnage container and/or for releasably securing the panel 120B to the frame member 102D of the dunnage container, and it will be understood that any such other conventional locking, latching or securing structures are intended to fall within the scope of this disclosure.

In alternate embodiments, one or more structures may be provided to releasably lock the panels 120A, 120B relative to one another in their spaced apart positions (as illustrated in FIG. 13) in which the panels 120A-120C completely or nearly cover the opening of the dunnage container. Such one or more structures may likewise be provided to lock the framed panels 24A, 24C of the embodiment illustrated in FIGS. 1-12 relative to one another in their spaced apart positions in which the panels 24A-24C completely or nearly cover the opening of the dunnage container. As one example of such structures, which should not be considered to be limiting in any way, two elongated rods, telescoping or otherwise, may each be coupled at one end thereof, e.g., pivotably, to inwardly-facing sides of each of the panels 120A, 120B (and/or 24A, 24C), and may be pivotably or otherwise releasably joined to one another at opposite ends thereof. Such rods may be pivoted or otherwise moved to a locked or locking position between the two panels 120A, 120B and across the panel 120C (or between the two panels 24A, 24C and across the panel 24B) which forces the panels 120A, 120B (or 24A, 24C) away from one another and/or otherwise prevents relative movement of the panels 120A, 120B (or 24A, 24C) toward one another. Such rods may also be pivoted or moved to a release position which draws the panels 120A, 120B (or 24A, 24C) toward one another and/or otherwise allows relative movement of the panels 120A, 120B (or 24A, 24C) toward one another. Those skilled in the art will recognize other structures for achieving the functionality just described, and it will be understood than any such other structures are intended to fall within the scope of this disclosure.

As best shown in FIGS. 14 and 15, the flexible panel 120C has one end 128C and another end 128D opposite the end 128C, wherein both ends 128C, 128D are illustratively spaced apart from the ends 122C, 124C and 122D, 124D respectively of the cover panels 120A, 120B respectively. In alternate embodiments, the length of the flexible panel 120C may be the same as that of the cover panels 120A, 120B such that the end 128C of the flexible panel 120C is collinear with the ends 122C, 124C of the cover panels 120A, 120B and the end 128D of the flexible panel 120C is collinear with the ends 122D, 124D of the cover panels 120A, 120B. In still other embodiments, only one or the other of the ends 128C, 128D may be collinear with respective ends of the cover panels 120A, 120B. In any case, in some embodiments at least one brush-style strip or other conventional sealing device or structure may be mounted within one or more of the channels 110A, 110B, 114A, 114B at least partially along its/their length(s) to guide movement of either or both of the cover panels 120A, 120B along the respective channels and/or to prevent or impede ingress of debris into one or more of the channels 110A, 110B, 114A, 114B.

Referring now to FIGS. 16A-17B, another embodiment is shown of a dunnage container closure arrangement including a sliding cover assembly 200 operatively mounted to a closed, dunnage container frame assembly. The dunnage container frame assembly illustratively includes the four frame members as illustrated in the embodiments 10, 100 illustrated in FIGS. 1-15 and described above. In the embodiment illustrated in FIGS. 16A-16C, the assembly 200 illustratively includes two rigid or semi-rigid panels 202, 204 separated, and coupled together, by a flexible or semi-flexible panel 206 as described above. The assembly 200 illustratively includes two additional features, either or both of which may be alternatively or additionally implemented in either or both of the embodiments described above. For example, in the illustrated embodiment, the opposed sides of the panels 202, 206 are secured together by an elongated, rigid or semi-rigid strip 208, and the opposed sides of the panels 206, 204 are likewise secured together by another elongated, rigid or semi-rigid rib 210. In this embodiment, an elongated top rail structure or assembly 212 is attached to an inwardly-facing surface of the top frame member of the dunnage container, and an opposed elongated rail structure 1068 is attached to an inwardly-facing surface of the bottom frame member 1028 such that the rails structures 212, 214 face one another.

In the illustrated embodiment, the top rail structure 212 includes side-by-side, elongated rails attached to the inner surface of the frame member 102A such that the rails of the top rail structure 212 extend across the opening of the dunnage container, and the bottom rail structure 214 likewise includes side-by-side, elongated rails attached to the inner surface of the frame member such that the rails of the bottom rail structure 214 extend across the opening of the dunnage container opposite the top rail structure 212. In alternate embodiments, the rail structures 212, 214 may form the frame member of the dunnage container.

Figure 17A:
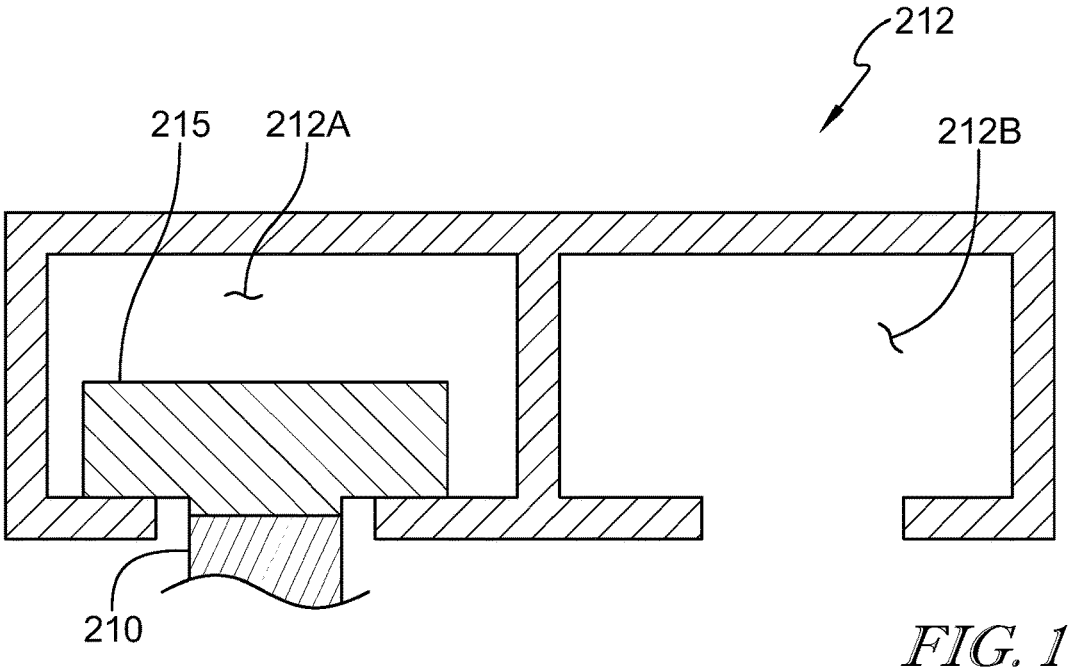
FIG. 17A is a cross-sectional view of the top rail of the sliding cover assembly of FIGS. 16A-16C as viewed along section lines X1-X1 of FIG. 16A.

In the illustrated embodiment, the side-by-side rails of the top rail structure 212 are configured so as to define C-shaped channels 212A, 212B. A sliding member 215 is illustratively attached to, or is integral with, the top of the rib 210, and is sized to be slidingly received within one of the channels 212A, 2128 such that the rib 210 is suspended by, but slidable along, the channel 212A, 2128, as illustrated by example in FIG. 17A. A similar or identical sliding member is illustratively attached to, or is integral with, the top of the rib 208, and is likewise sized to be slidingly received within the other one of the channels 212A, 2128 such that the rib 208 is likewise suspended by, but slidable along, the channel 212A, 2128. In this manner, the sliding cover assembly 200 is suspended from the top rail structure 212 with the panels 202, 204, 206 slidable along the top rail structure 212. In some alternate embodiments, the rib(s) 208, 210 may be omitted, and the sliding member(s) 215 may be mounted directly to the top edge(s) of the panel(s) 202, 204. In other alternate embodiments, the sliding member 215 may define a slot therein sized to at least partially receive therein the two feet of the "C" shaped bottom portion of the channels 212A, 2128, e.g., such that an upper portion of the sliding member 215 resides within the channels 212A, 212B, as illustrated in FIG. 17A, and a lower portion of the sliding member 215 extends below the channels 212A, 2128 with the feet of the "C" shaped bottom portions of the channel 212A, 2128 riding within the slot defined between the upper and lower portions. In any case, the sliding member 215 may extend the width of the cover panel 202, 204 in some embodiments, and in other embodiments multiple sliding members 215 may be used for each panel 202, 204.

In any case, the bottom rail structure 214 is illustratively configured as described above with respect to the embodiment 10 illustrated in FIGS. 1-12, e.g., side-by-side U-shaped channels, and the bottom ends of the ribs 208, 210 illustratively extend into, but are not secured to or within the channels of the bottom rail structure 214. As such, the bottom ends of the ribs 208, 210, and thus the bottom edges of the panels 202, 204, slide along respective ones of the channels of the bottom rail structure 214 as the panels 202, 204 slide relative to the top rail structure 212. In embodiments which do not include the ribs 208, 210, the bottom edges of the panels 202 may extend into, and slide along, the side-by-side channels of the bottom rail structure 214. In some alternate embodiments, the bottom rail structure 214 may be configured similarly or identically to the top rail structure 212 just described, and in such embodiments sliding members 215 may be mounted to the bottom ends of the ribs 208, 210 (or directly to the bottom edges of the panels 208, 210).

Figure 16A:
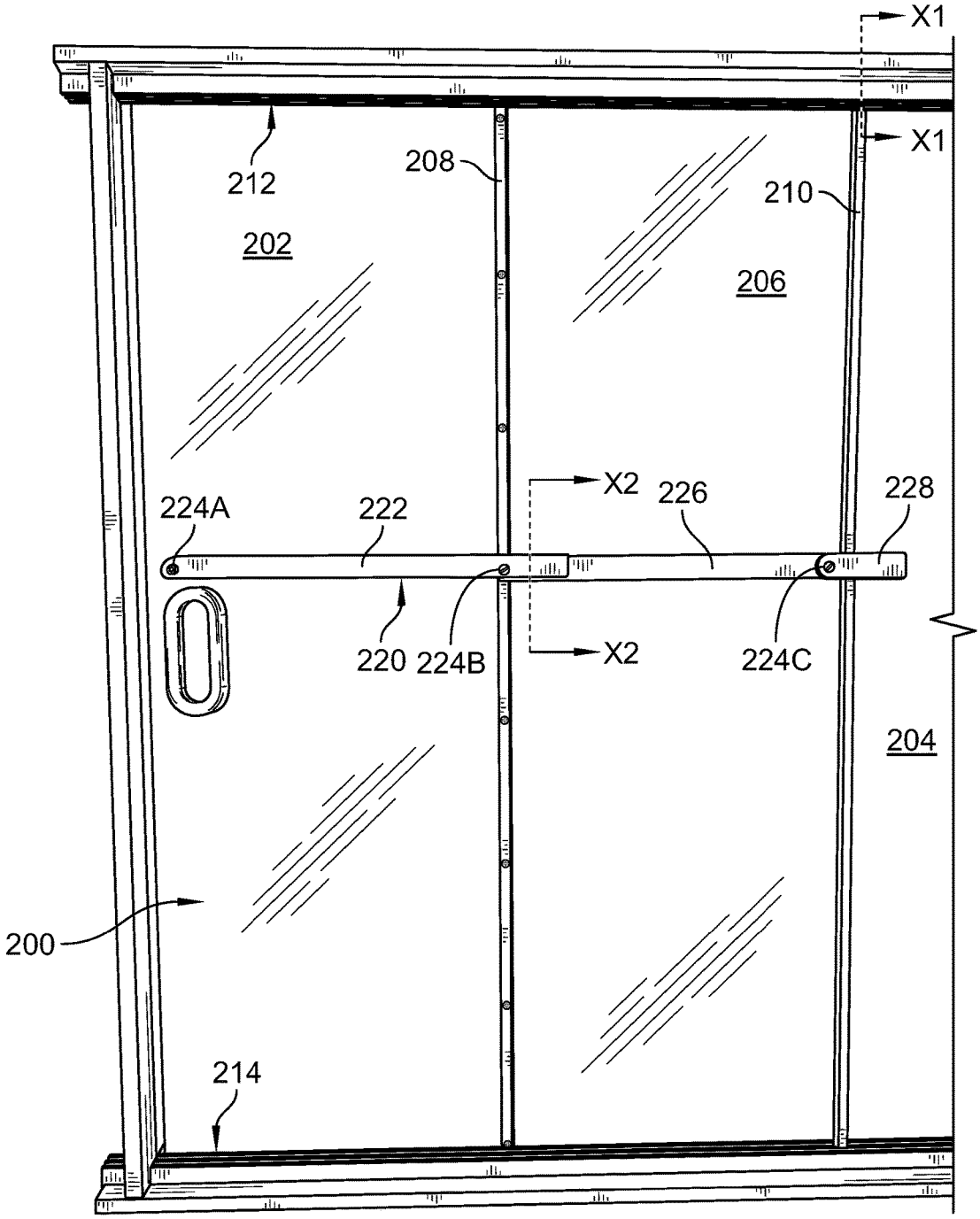
FIG. 16A is a front elevational view of yet another embodiment of a sliding cover assembly operatively mounted to a closed frame assembly representing an open top or side of a conventional top-loading or side-loading dunnage container, showing a cover locking assembly in a locked position or state.
Figure 16B:
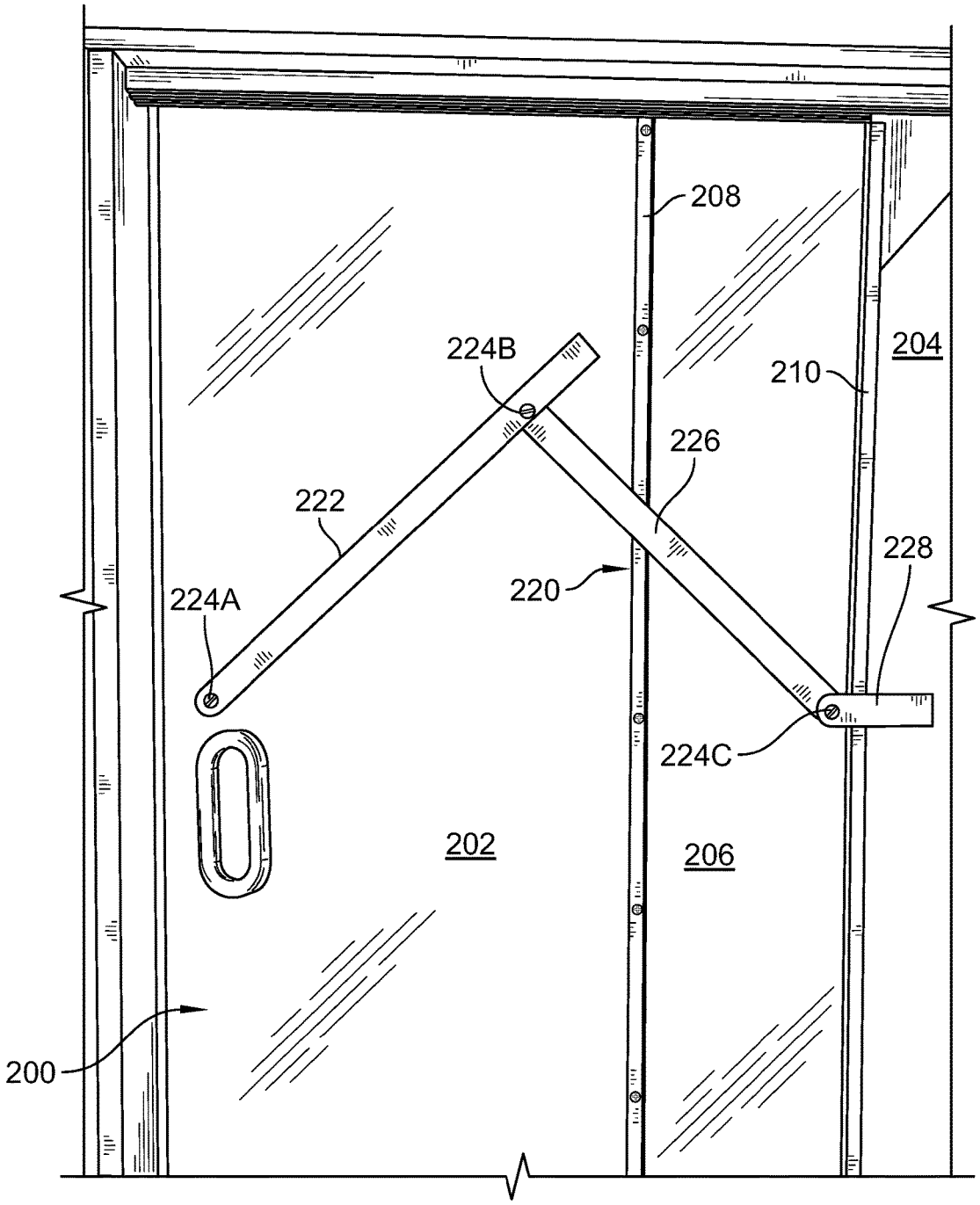
FIG. 16B is a magnified view of the sliding cover assembly of FIG. 16A showing the cover locking assembly in an unlocked state with the right-most panel moved toward and partially overlaying the left-most panel.
Figure 16C:
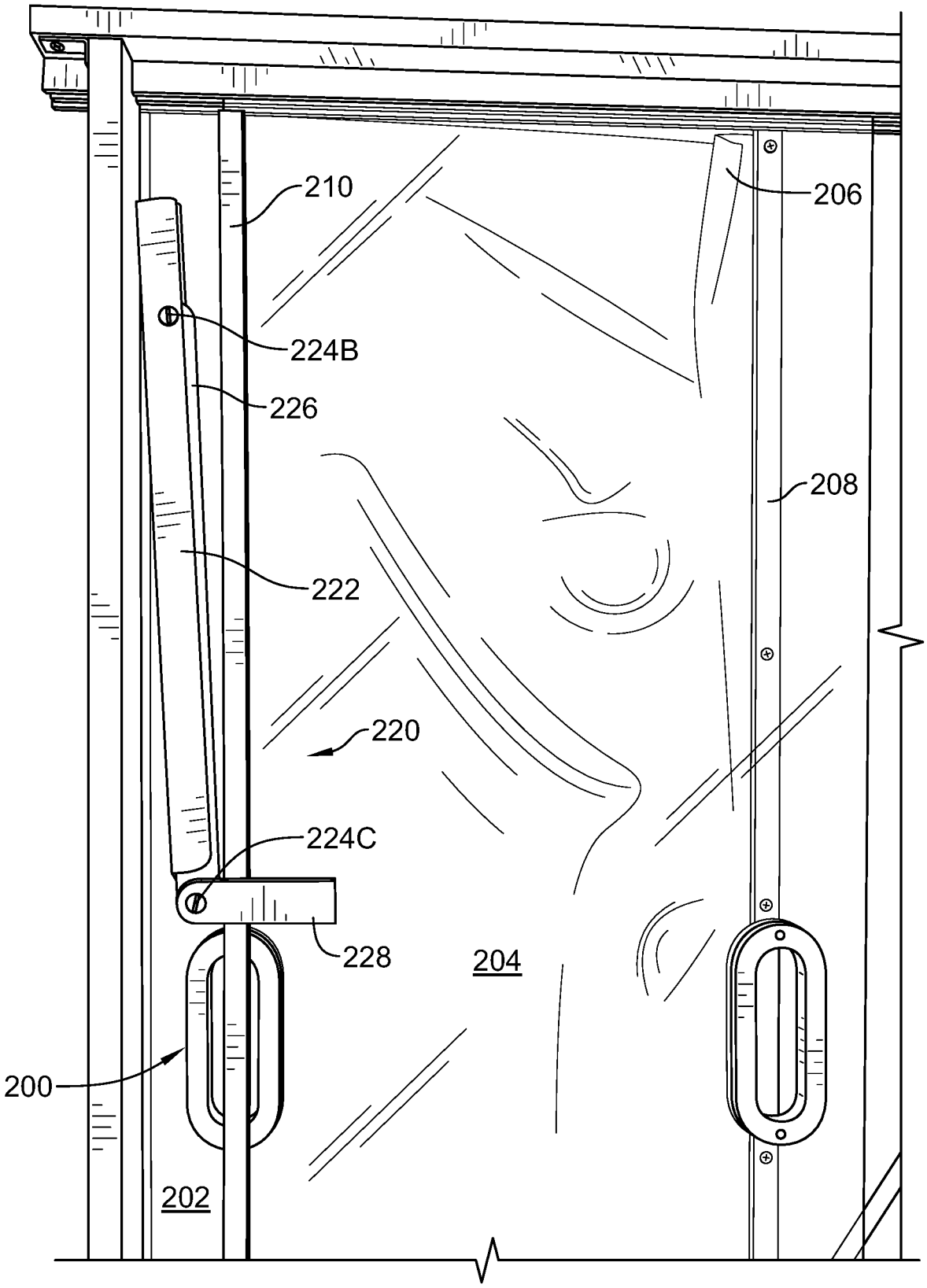
FIG. 16C is another magnified view of the sliding cover assembly of FIGS. 16A and 16B showing the cover locking assembly in an unlocked state with the right-most panel overlaying the left-most panel.

In the embodiment illustrated in FIGS. 16A-17B, the sliding panel assembly 200 further illustratively includes a cover locking assembly 220 operatively mounted to the assembly 200. The cover locking assembly 220 is illustratively operable to selectively lock the panels 202, 204 relative to one another in their spaced apart positions (as illustrated in FIG. 16A) in which the combination of the panels 202, 204, 206 completely or nearly cover the opening of the dunnage container, and to selectively unlock the panels 202, 204 to allow the panels 202, 204 to move relative one another to expose at least a portion of the opening of the dunnage container. In the illustrated embodiment, the cover locking assembly 220 is provided to in the form of a number of rigid rods or ribs pivotally mounted to the panels 202, 204 and pivotally mounted to one another in a manner configured to allow locking and unlocking of the panels 202, 204 to one another. For example, an elongated rod or rib 222 is pivotally mounted at one end thereof to the panel 202 at or adjacent to the free side of the panel 202 via a conventional pivoting member 224A, e.g., a screw, bolt, rivet or the like. Spaced apart from an opposite end of the rod or rib 222, one end of another elongated rod or rib 226 is pivotally mounted thereto via another conventional pivoting member 224B. The opposite end of the rod or rib 226 is pivotally mounted to one end of a comparatively shorter rod or rib 228 via yet another pivoting member 224C, and the rod or rib 228 is illustratively affixed to the rib 210 of the panel assembly 200 in a conventional manner, e.g., via one or more conventional fixation members, via adhesive or other bonding materials or the like. The end of the rod or rib 222 near the free side of the panel 202 is thus pivotable relative to the panel 202, the end of the rid or rib 226 is pivotable relative to a portion of the rod or rib 222 spaced apart from the opposite end thereof, and the opposite end of the rod or rib 226 is pivotable relative to the rod or rib 228.

Figure 17B:
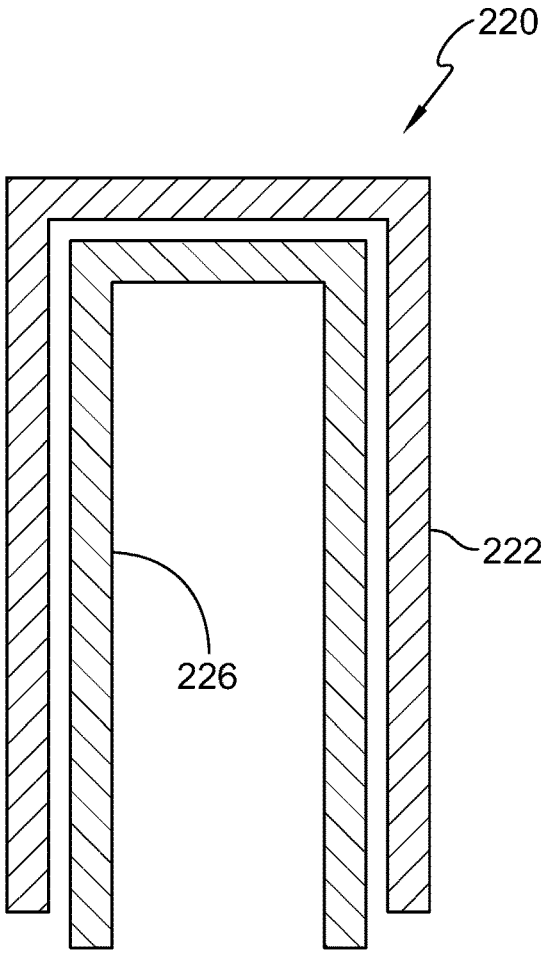
FIG. 17B is a cross-sectional view of the panel locking assembly of the sliding cover assembly of FIGS. 16A-16C as viewed along section lines X2-X2 of FIG. 16A.

In the illustrated embodiment, the rods or ribs 222, 226 are provided in the form of elongated U-shaped channels with the channel opening of the rod or rib 222 larger than the exterior profile of the rod or rib 226 such that the rod or rib 226 is receivable within the U-shaped channel of the rod or rib 222 in the locked position of the cover locking assembly 220 as illustrated by example in FIGS. 16A and 17B. The free end of the rod or rib 226 is illustratively pivoted, about the pivoting member 224B, upwardly and away from the rod or rib 226 to unlock the cover locking assembly 220 so that the panels 202, 204 may be moved relative to one another. As shown by example in FIG. 16B, with the cover locking assembly 220 unlocked as just described, the panel 202 is moved toward the panel 22 which causes (i) the free end of the rod or rib 226 to pivot, about the pivoting member 224B, upwardly and away from the rod or rib 226, (ii) the rod or rib 226 to pivot about the pivoting member 224C relative to the rod or rib 228 and to further pivot about the pivoting member 224B relative to the rod or rib 226, and (iii) the rod or rib 222 pivotally mounted to the panel 222 to pivot about the pivoting member 224A relative to the panel 202. As the panel 204 is further moved relative to the panel 202 so as to overlay the panel 202, the rods or ribs 222, 226 continue to pivot as just described, and the rod or rib 226 is received along its length within the channel of the rod or rib 222. The cover locking assembly 220 may be returned to its locked position by reversing the process just described with respect to FIGS. 16A-16C.

It will be appreciated that the cover locking assembly 220 may alternatively be mounted such that the pivoting end of the rod or rib 222 is mounted to the panel 204 at or near the free side thereof. It will be further appreciated that the cover locking assembly 220 may alternatively be implemented in embodiments in which the panels 202, 204 are flexible panels as described above with respect to FIGS. 1-14 and/or in embodiments in which the panels 202, 204 are rigid or semi-rigid but in which the ribs or strips 208, 210 are omitted.

Figure 18A:
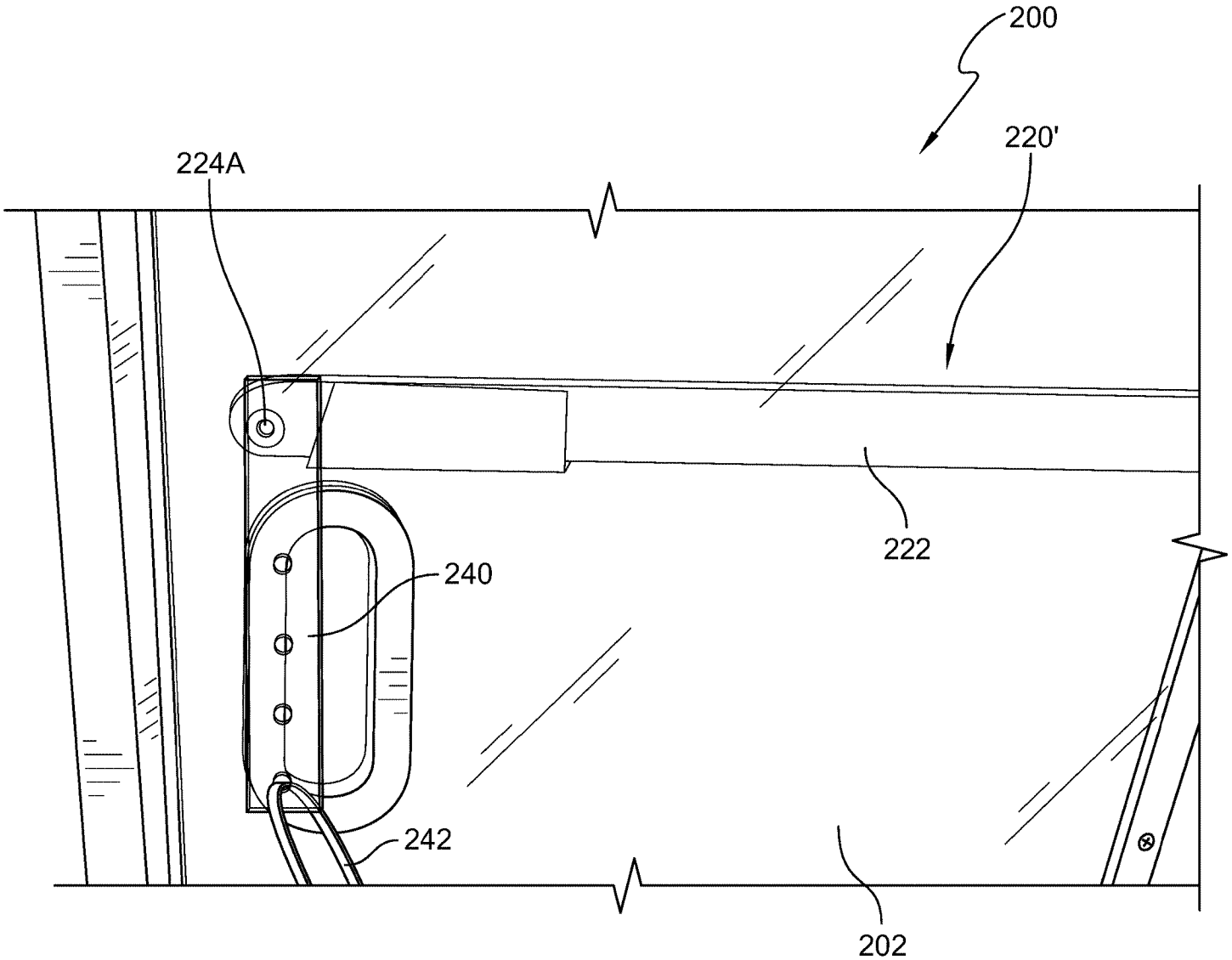
FIG. 18A is a magnified view similar to FIG. 16C illustrating an embodiment of an articulating handle operatively coupled to the cover locking assembly.
Figure 18B:
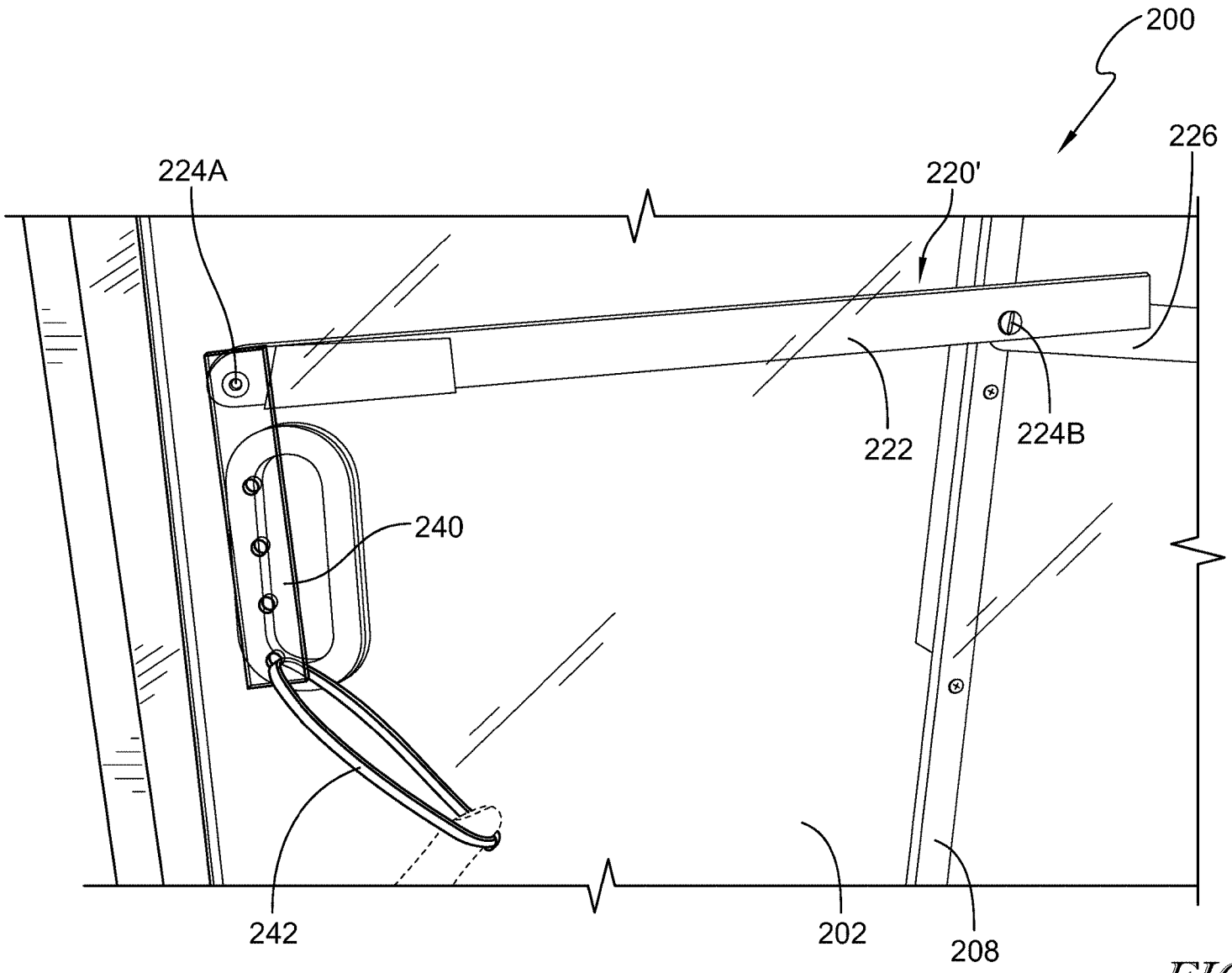
FIG. 18B is a magnified view similar to FIG. 18A showing operation of the articulating handle to unlock the cover locking assembly.

In some embodiments, the cover locking assembly 220 may be modified to include an unlocking mechanism for selectively unlocking the assembly 220. Referring to FIGS. 18A and 18B, an alternate embodiment of the cover locking assembly 220' is shown which includes an elongated articulating handle 240, e.g., in the form of a rigid or semi-rigid strip, pivotally mounted at one end thereof to the end of the rod or rib 222 via the pivoting member 224. In some embodiments, a loop 242 or other convenient structure may be affixed to the opposite end of the handle 240 to facilitate movement of the handle 240 relative to the cover locking assembly 220. In this embodiment, the cover locking assembly 220 is illustratively unlocked by moving the free end of the handle 240 toward the rod or rib 226, as illustrated by example in FIG. 18B. As the handle 240 pivots about the pivoting member 224A relative to the rod or rib 222, the opposite end of the rod or rib 222 is forced away from the rod or rib 226 so as to unlock the cover locking assembly 220 as further illustrated by example in FIG. 18B.

While this disclosure has been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected. For example, it will be understood that whereas the various embodiments of the sliding cover assembly have been shown and described as covering a front (or side or rear or top) opening of a dunnage container with the panels of the sliding cover assembly being movable from side-to-side relative to the dunnage container, the sliding cover assembly may alternatively be mounted and/or positioned relative to the dunnage container such that the panels of the sliding cover assembly are movable from top-to-bottom, and vice versa, relative to the dunnage container, e.g., the sliding cover assembly depicted in FIGS. 1, 13 and/or 16A may be rotated 90 degrees such that the panels slide up and down rather than side-to-side. As another example, whereas some of the various embodiments of the sliding cover assembly have been shown and described as including various handle structures, it will be understood that any handle structure, whether protruding from the front surface one or more of the panels, integral with one or more of the panels and/or including one or more openings defined through one or more of the panels, may be included in any of the sliding cover assembly embodiments. In some such embodiments, handle structures may be defined only at the outer edges of the outer panels, although in other embodiments handle structures may be defined at opposite edges of one or both of the outer panels, and/or one or more handle structures may be defined in-board of either side edge of either or both the outer panels.

What is claimed is:

1. A cover assembly for a dunnage container, comprising:

an elongated first rail affixed to or integral with the dunnage container and extending along one edge of an opening to the dunnage container, an elongated second rail affixed to or integral with the dunnage container and extending along another edge of the opening opposite the one edge, a first cover panel configured to extend between the first and second rails over at least a portion of the opening and to slide along a first path defined longitudinally along the first and second rails, a second cover panel configured to extend between the first and second rails over at least a portion of the opening and to slide along a second path defined longitudinally along the first and second rails parallel with the first path such that the first and second cover panels can slidingly overlay one another, and a flexible panel affixed to and between opposing sides of the first and second cover panels, wherein the flexible panel is redirectable in response to sliding of either or both of the first and second cover panels toward a other of the first and second cover panels to trap the flexible panel therebetween as one of the first and second cover panels overlays the other of the first and second cover panels, and wherein the flexible panel is further redirectable in response to sliding of either or both of the first and second cover panels away from the other of the first and second cover panels to extend the flexible panel therebetween.

2. The cover assembly of claim 1, wherein each of the first and second rails define first and second channels extending parallel to one another at least partially along a length thereof, and wherein first and second ends of the first cover panel are received within the first channels of the first and second rails such that the first cover panel is slidable therealong, and first and second ends of the second cover panel are received within the second channels of the first and second rails such that the second cover panel is slidable therealong.

3. The cover assembly of claim 1, wherein the first cover panel comprises:

a first frame assembly having interconnected first, second and opposing side frame members, and a first flexible or semi-flexible panel affixed to and covering the first frame assembly.

4. The cover assembly of claim 3, wherein the first cover panel further comprises means coupled to opposite ends of the first and second side frame members of the first frame assembly for slidably engaging the first channel.

5. The cover assembly of claim 1, wherein the second cover panel comprises:

a second frame assembly having interconnected first, second and opposing side frame members, and a second flexible or semi-flexible panel affixed to and covering the second frame assembly.

6. The cover assembly of claim 5, wherein the second cover panel further comprises means coupled to opposite ends of the first and second side frame members of the second frame assembly for slidably engaging the second channel.

7. The cover assembly of claim 1, wherein the second cover panel comprises a rigid or semi-rigid panel.

8. The cover assembly of claim 1, wherein the first cover panel comprises a first rigid or semi-rigid panel, and wherein the second cover panel comprises a second rigid or semi-rigid panel.

9. The cover assembly of claim 8, wherein each of the first and second rails define first and second channels extending parallel to one another at least partially along a length thereof, and wherein the cover assembly further comprises:

means, coupled to the first cover panel, for slidably engaging the first channel of one of the first and second rails to suspend the first cover panel from the one of the first and second rails such that the first cover panel is slidable therealong, and means, coupled to the second cover panel, for slidably engaging the second channel of the one of the first and second rails to suspend the second cover panel from the one of the first and second rails such that the second cover panel is slidable therealong.

10. The cover assembly of claim 1, further comprising at least one handle mounted to at least one of the first and second cover panels.

11. The cover assembly claim 10, wherein the at least one handle comprises a first handle mounted to one of the first and second cover panels adjacent to a corresponding side of the dunnage container.

12. The cover assembly of claim 11, further comprising a second handle mounted to the other of the first and second cover panels adjacent to a corresponding side of the dunnage container.

13. The cover assembly of claim 1, further comprising means for releasably securing the first cover panel to a corresponding side of the dunnage container.

14. The cover assembly of claim 1, further comprising means for releasably securing the second cover panel to a corresponding side of the dunnage container.

15. The cover assembly of claim 1, further comprising means for releasably preventing relative movement between the first and second cover panels with the flexible panel extended therebetween.

16. The cover assembly of claim 1, further comprising means for coupling the opposing sides of the first and second cover panels to respective sides of the third panel.

17. The cover assembly of claim 1, wherein the first cover panel is one of light-blocking, opaque or transparent.

18. The cover assembly of claim 1, wherein the second cover panel is one of light-blocking, opaque or transparent.

19. The cover assembly of claim 1, wherein the third cover panel is one of light-blocking, opaque or transparent.

* * * * *